US008905740B2

(12) United States Patent
Lim

(10) Patent No.: US 8,905,740 B2
(45) Date of Patent: Dec. 9, 2014

(54) MOBILE PRODUCTION SYSTEM FOR CEMENT PANEL

(76) Inventor: Jee Keng James Lim, Singapore (SG)

( * ) Notice: Subject to any disclaimer, the term of this patent is extended or adjusted under 35 U.S.C. 154(b) by 78 days.

(21) Appl. No.: 13/878,503

(22) PCT Filed: Oct. 22, 2010

(86) PCT No.: PCT/SG2010/000404

§ 371 (c)(1),
(2), (4) Date: May 8, 2013

(87) PCT Pub. No.: WO2012/053973

PCT Pub. Date: Apr. 26, 2012

(65) Prior Publication Data

US 2013/0330435 A1 Dec. 12, 2013

(51) Int. Cl.

| | |
|---|---|
| ***B28B 17/00*** | (2006.01) |
| ***B28B 15/00*** | (2006.01) |
| ***B28B 5/04*** | (2006.01) |
| ***B28B 23/00*** | (2006.01) |
| ***E04G 21/16*** | (2006.01) |

(52) U.S. Cl.

CPC ..... *B28B 15/002* (2013.01); *B28B 5/04* (2013.01); *B28B 17/0081* (2013.01); *B28B 23/0056* (2013.01); *B28B 23/0068* (2013.01); *E04G 21/16* (2013.01)

USPC ..... 425/135; 425/62; 425/88; 425/200; 425/213

(58) Field of Classification Search

USPC ..... 425/135, 62, 88, 200, 213

See application file for complete search history.

(56) References Cited

U.S. PATENT DOCUMENTS

| | | | | |
|---|---|---|---|---|
| 5,141,429 | A * | 8/1992 | Menninga | 425/439 |
| 2010/0118640 | A1* | 5/2010 | Matye et al. | 366/6 |
| 2010/0189953 | A1* | 7/2010 | Lim | 428/119 |

FOREIGN PATENT DOCUMENTS

| | | | |
|---|---|---|---|
| CN | 101474826 | A | 7/2009 |
| FR | 2241192 | A5 | 3/1975 |
| WO | WO-86/00043 | A1 | 1/1986 |
| WO | WO-2008/143591 | A1 | 11/2008 |

OTHER PUBLICATIONS

Tayshetye, A., "International Search Report", for PCT/SG2010/000404, as mailed Jan. 11, 2011, 3 pages.

* cited by examiner

*Primary Examiner* — Joseph S Del Sole
*Assistant Examiner* — John Robitaille
(74) *Attorney, Agent, or Firm* — Winstead PC

(57) ABSTRACT

The invention relates to an automated mobile production system for fabricating a cement panel or composite cement panel. The system includes a movable container and a conveyor system inside the container aligned along a longitudinal axis of the container. The system further includes a plurality of independent manufacturing stations inside the container and aligned along the conveyor system. The container is preferably an international standard shipping container so that being compact and movable from place to place. Further, the system includes a removable mortar mixing station affixed to the outer top side of the container when the system is in operation, and is removed and stored inside the container during transport of the system.

32 Claims, 19 Drawing Sheets

MOBILE PRODUCTION SYSTEM FOR CEMENT PANEL

FIELD OF THE INVENTION

This invention relates to an automated mobile production system for fabricating a cement panel or composite cement panel. More particularly, this invention relates to an automated mobile production system having a plurality of independent manufacturing stations aligned along a conveyor system inside a movable container. Still more particularly, this invention relates to an automated mobile production system having a removable mortar mixing station affixed to an outer top side of the container when the system is in operation, and is removed and stored inside the container during transport of the system.

BACKGROUND OF THE INVENTION

In construction industry, various types of cement panels or composite cement panels are used to provide water drainage, thermal insulation, or form part of a waterproofing system for a roof deck or other surfaces. A composite cement panel having a thermal insulation foam board encapsulated in cement, and a method of fabricating the panel were disclosed in PCT International Application Number PCT/SG2008/000174 entitled "Composite Cement Panel" in the name of Lim Jee Keng James and filed on 9 May 2008. Typically, cement panels or composite cement panels are fabricated either manually or in an automated or semi-automated production facility and then delivered to a construction site at a different location. The construction site may located some distance away from the production facility. Thus, the expenses of transportation for delivering the panels to a construction site must be added to the cost of the panels. Further, the panels and raw materials, such as cement powder and foam boards, may be subject to taxation at every step of the process as the material and panels are transported from jurisdiction to jurisdiction, thus increasing the cost of the panels. Moreover, panels are not easily transportable and exportable due to their relatively big size, heavy weight, and fragility. The remoteness of the production facility of the panels from the construction site may also cause delays in construction when additional panels are transported from the production plant to the construction site. Thus, those skilled in the art are constantly striving to provide a facility that can manufacture these panels directly at a construction site to reduce manufacturing costs of the panels and minimize constructions delays.

SUMMARY OF THE INVENTION

The above and other problems are solved and an advance in the art is made by a mobile production system for a composite cement panel or cement panel in accordance with this invention. One advantage of an automated mobile production system in accordance with this invention is that the system is compact and movable to any construction site for fabricating the panels directly at the site, thereby saving transportation and production costs, improving service level to clients, and saving production space. A second advantage of a system in accordance with this invention is that the system is automated and requires less manual labour to produce the panels. This further minimizing production costs, increasing throughputs, and assuring the quality of the panels is consistent. A third advantage of a system in accordance with this invention is that the system includes a number of smaller independent stations which can be easily assembled and disassembled in short time to enable rapid deployment and relocation of the system.

This invention relates to an automated mobile production system for fabricating a composite cement panel or cement panel. In accordance with some embodiments of this invention, the mobile production system includes a container having a top side, a bottom side, a first side, a second side, a first end, and a second end. A floor on an inner bottom side of the container is coated with a layer of anti-slip coating. In accordance with some of these embodiments, the container is a standard international shipping container. Further, the container also serves as a storage for housing all stations and components of the system; and possibly raw materials for cement panels during transport of the system.

The mobile production system further includes a conveyor system inside the container aligned substantially along a longitudinal axis of the container from a first end to a second end of the container. The mobile production system further includes a plurality of manufacturing stations located along the conveyor system inside the container. Each of the manufacturing stations performs a processing step in the manufacture of composite cement panels. In accordance with some embodiments of this invention, the manufacturing stations are arranged substantially along a longitudinal axis of the container to form a maintenance walkway and a production walkway on opposing sides of the container separated by the conveyor system and the manufacturing stations.

The mobile production system also includes a removable mortar mixing station. The mortar mixing station is removably affixable to an outer top side of the container proximate the first end of the container. The mortar mixing station includes a mixing tank for preparing mortar, and a loading chute. The loading chute is affixed to an inner top side of the container to deliver mortar prepared in the mixing tank to manufacturing stations in the container through an opening in the top side of the container. The mortar mixing station is affixed to the outer top side of the container during manufacturing of composite cement panels. The mortar mixing station is then removed from the outer top side of the container and placed inside the container during transport of the mobile production system. In accordance with some embodiments of this invention, the mortar mixing station includes a platform with legs, mounted on a surface proximate the mixing tank, to allow a user to stand on the platform for loading mortar powder into the mixing tank or doing maintenance work.

In accordance with some embodiments of this invention, the mobile production system includes a solar panel affixed to the outer top side of the container to generate electricity for the system. In accordance with some of these embodiments, an array of solar panels is affixed to the outer top side of the container. In accordance with still further embodiments, the solar panels may be removable from the outer top side of the container and stored inside the container during transport of the system. A mounting structure for the solar panels may include a hinge element movable between a first position and a second position. In the first position, the solar panels are folded to within a perimeter of the top side of the container to protect the solar panels during transport of the system. In the second position, the solar panels are unfolded and extend beyond the perimeter of the top side of the container. In accordance with some other embodiments, a foldable rollable membrane type of solar panel may be used.

In accordance with some embodiments of this invention, the production may include a main control system that includes a processor and a memory. The memory stores instructions executable by the processor for controlling the manufacturing processes. The main control system provides commands for producing different types of panels, and relay collected data and/or generated data to a main server via a wireless or other network connection. In accordance with some of these embodiments, a sensor proximate one side of the conveyor system is connected to the main control system to detect the presence of a casting tray. The main control system triggers the start of the manufacturing process at one of the stations in response to the detection of the casting tray. In accordance with others of these embodiments, a main control panel and/or a sub-control panel may be connected to the main control system to provide a user interface for monitoring and controlling manufacturing processes of the mobile production system. In accordance with further embodiments of this invention, some of the manufacturing stations may have an associated station control panel connected to the main control system to provide a user interface for monitoring and controlling the process performed by the station. In accordance with still further embodiments of this invention, an alarm system may be connected to the main control system for reporting predefined abnormalities in the mobile production system.

In accordance with some embodiments of this invention, the manufacturing stations include a dispensing station. The dispensing station may include a dispensing tank and a shutter. The shutter may be affixed to an opening of the dispensing tank to dispense a predetermined amount of mortar into a casting tray. The opening and closing of the shutter is preferably controlled by a timer. In accordance with some of these embodiments, the dispensing station dispenses a predetermined amount of mortar over a foam board in a casting tray transferred from the foam board insertion station by the conveyor system. In accordance with some embodiments, the loading chute of the mortar mixing station connects to the dispensing tank of the dispensing station inside the container. In accordance with some of these embodiments, the dispensing tank may further include a stirrer for stirring the mortar regularly to mix the mortar and create a force to facilitate dispensing of the mortar into a casting tray placed below the dispensing tank. In accordance with some further embodiments, a weighing machine may be placed below a casting tray in the dispensing station to weigh the casting tray filled with mortar.

In accordance with some embodiments of this invention, the manufacturing stations include a levelling station for levelling the mortar in a casting tray transferred from the dispensing station by the conveyor system. In accordance with some embodiments of this invention, the levelling station may include a locating unit having tray press plates, foam guides, and foam press pins. The tray press plates press the edges of the casting tray to secure the casting tray in position. The foam guides contact the edges of a foam board to align, centre, and position the foam board in the casting tray. The foam press pins press the foam board into the casting tray to cause the foam board to contact tray pins protruding out from an inner bottom surface of the casting tray. In further of these embodiments, the levelling station may include a vibration motor to vibrate the casting tray secured by the locating unit and hence level the mortar in the casting tray.

In accordance with some embodiments of this invention, the manufacturing stations include a foam board insertion station for loading a foam board into a casting tray filled with a (bottom) layer of mortar transferred from the levelling station by the conveyor system. In accordance with some of these embodiments, the foam board insertion station may include a loading unit for storing foam boards. The loading unit also includes side guides for guiding a foam board into a casting tray. In some particular embodiments, the loading unit may hold up to 35 foam boards.

In accordance with some embodiments of this invention, the manufacturing stations also include a troweling station for levelling and/or smoothing the top surface of mortar of a composite cement panel in a casting tray transferred from the levelling station by the conveyor system. In accordance with some of these embodiments, the troweling station includes a troweling blade for levelling and/or smoothing the top surface of the composite cement panel in the casting tray. In further of these embodiments, the troweling station may also include a linear shaft for moving the troweling blade from a first edge to a second edge of the composite cement panel with the blade tilted at an adjustable angle with respect to the top surface of the composite cement panel in the casting tray.

In accordance with some embodiments of this invention, the manufacturing stations may include an optional finishing station to perform finishing on the top surface of a composite cement panel in a casting tray transferred from the troweling station by the conveyor system. In accordance with some of these embodiments, the finishing station may be a pebble finishing station. The pebble finishing station may include a feeding unit filled with pebbles for spreading pebbles over a top surface of the composite cement panel in a casting tray. In some further embodiments, the pebble finishing station may also include a pressing unit that has a press plate to press the pebbles into the top surface of the composite cement panel in the casting tray.

In accordance with some embodiments of this invention, the finishing station may be an imprint station. The imprint station may include an imprint unit. The imprint unit may include an imprint stamp for forming a pattern in the top surface of a composite cement panel in a casting tray. In accordance with some particular embodiments, the imprint station may include a cleaning unit. The cleaning unit may include a brush and an oil pan. The brush applies oil from the oil pan to clean the imprint stamp.

BRIEF DESCRIPTION OF DRAWINGS

The above and other problems are solved by features and advantages of an automated mobile production system in accordance with this invention described in the following detailed description and shown in the following drawings.

DETAILED DESCRIPTION OF THE INVENTION

This invention relates to an automated mobile production system for fabricating a cement panel or composite cement panel. Although a composite cement panel is described in the following, the system may also be used to fabricate a cement panel. More particularly, this invention relates to an automated mobile production system having a plurality of independent manufacturing stations aligned along a conveyor system inside a movable container. Still more particularly, this invention relates to an automated mobile production system having a removable mortar mixing station affixed to an outer top side of the container when the system is in operation, and is removed and stored inside the container during transport of the system.

Figure 1:
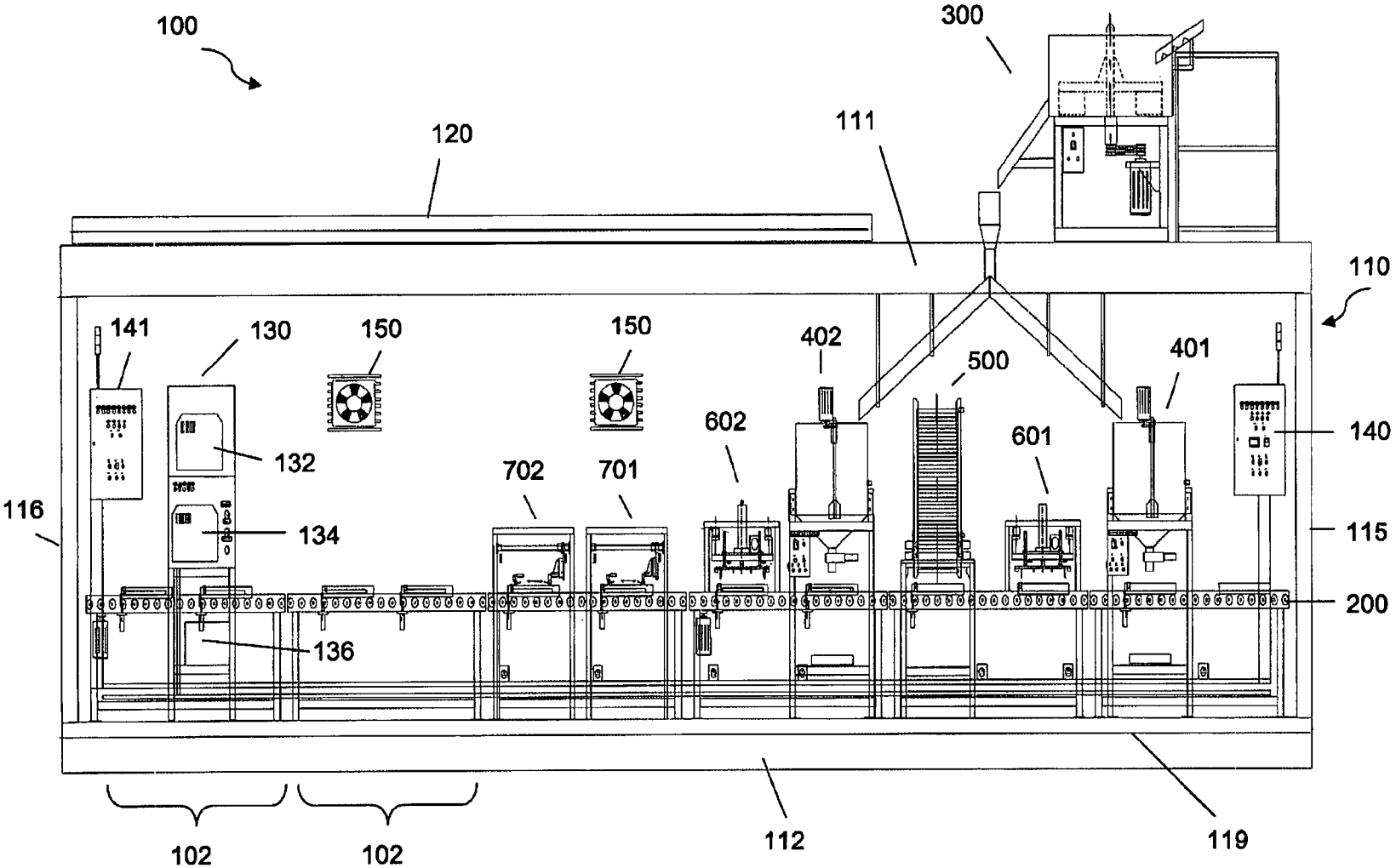
FIG. 1 illustrating a side elevation view of a mobile production system in accordance with an embodiment of this invention.
Figure 12:
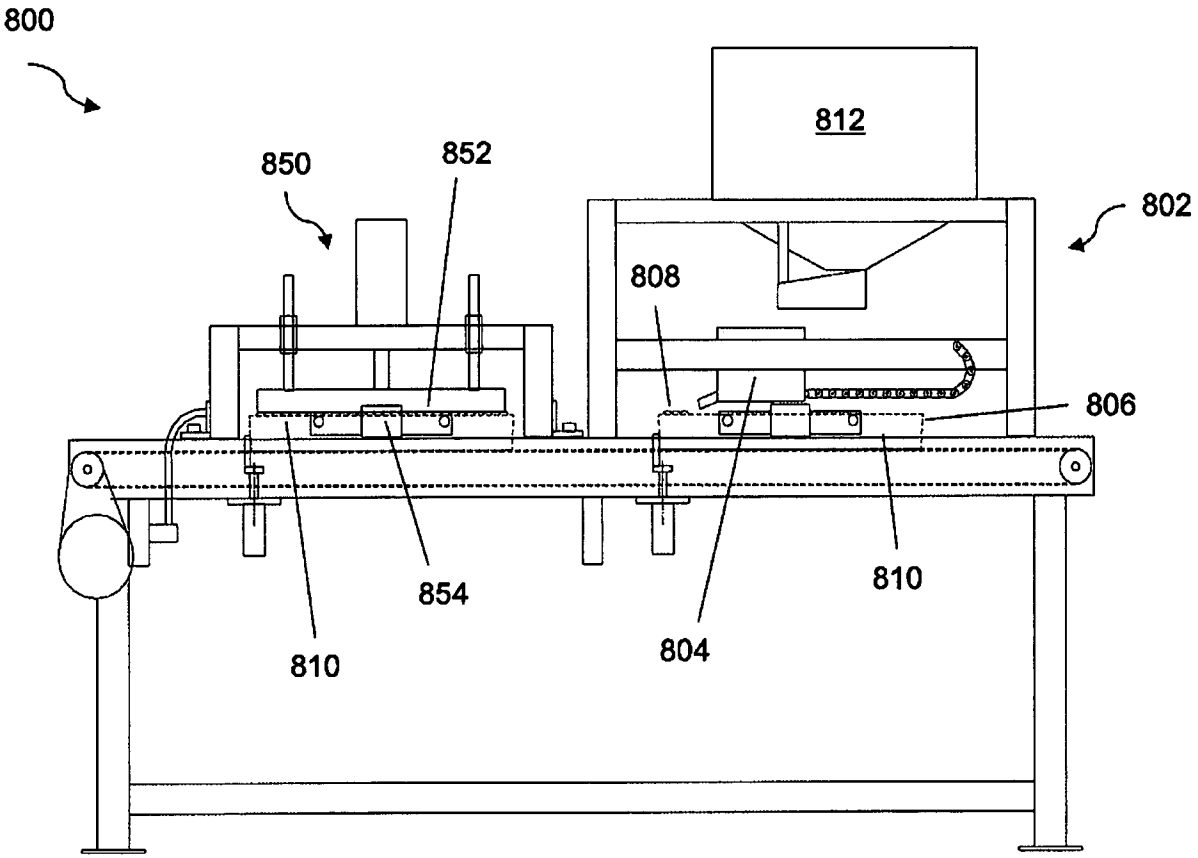
FIG. 12 illustrating a side view of a pebble finishing station of an embodiment of the mobile production system as illustrated in FIG. 1.
Figure 13:
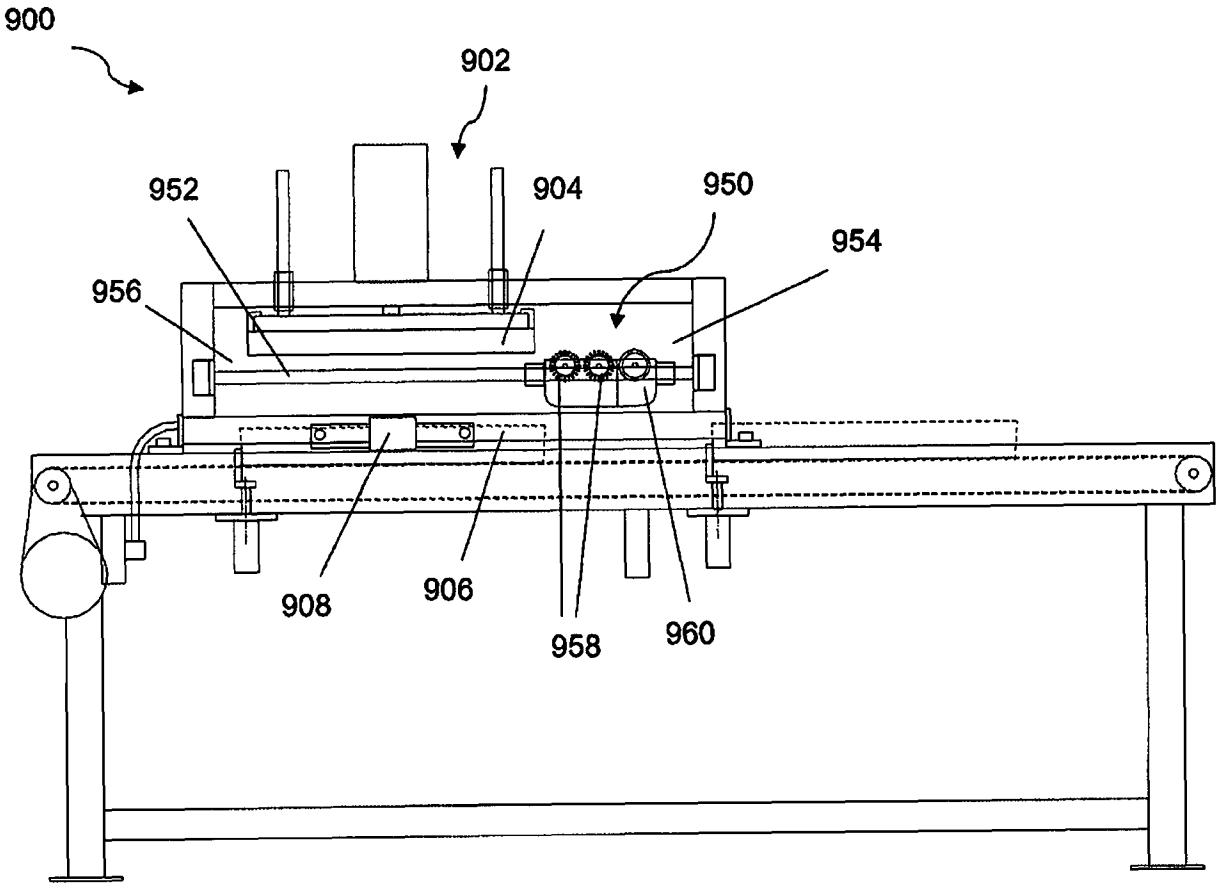
FIG. 13 illustrating a side view of an imprint station of an embodiment of the mobile production system as illustrated as in FIG. 1.
Figure 20:
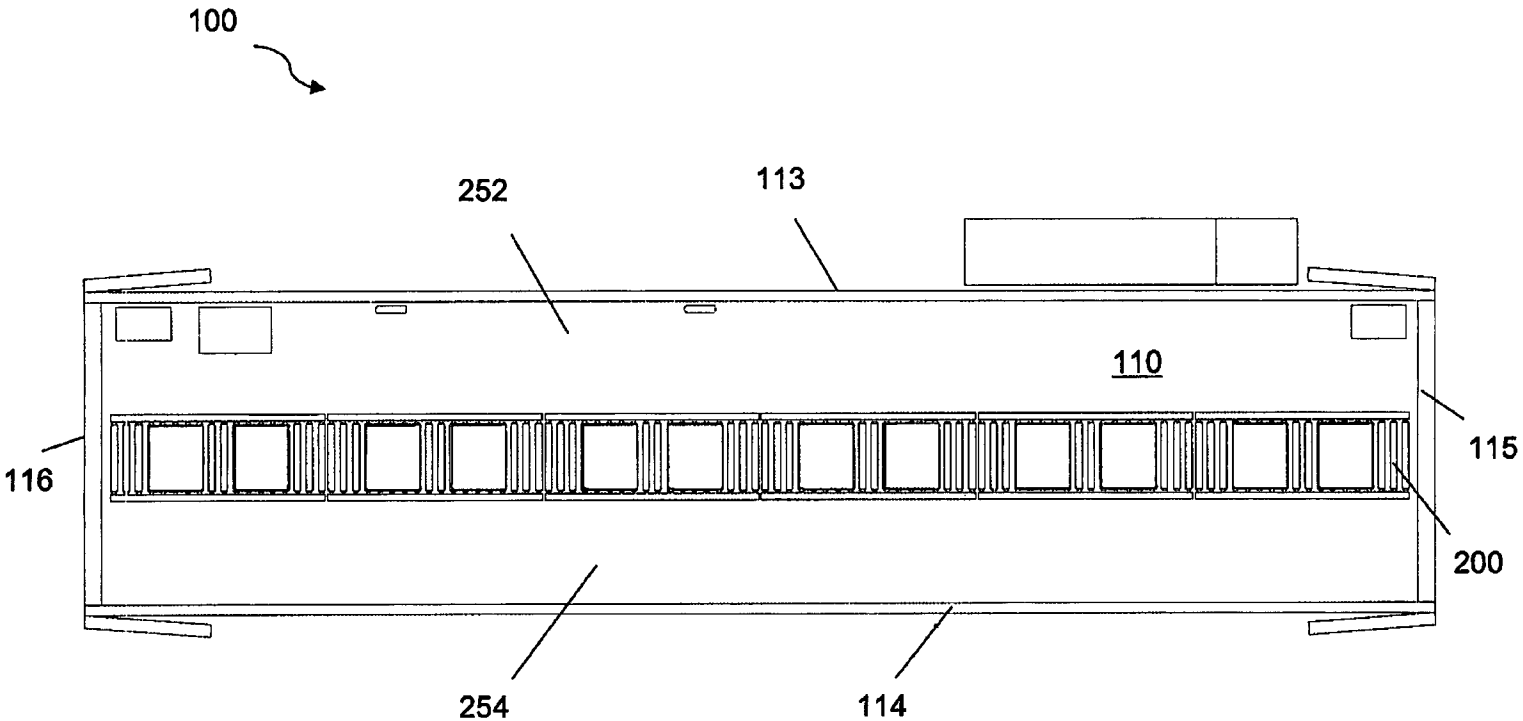
FIG. 20 illustrating an overhead view of the embodiment of the mobile production system as illustrated in FIG. 1.

FIG. 1 illustrates a side elevation view of automated mobile production system 100 in accordance with an embodiment of this invention. Mobile production system 100 comprises container 110; solar panels 120 on the outer top side of container 110; conveyor system 200 inside container 110; mortar mixing station 300 on the outer top side of container 110; independent manufacturing stations inside container 110; and service unit 130 inside container 110. Independent manufacturing stations include first and second dispensing stations 401 and 402 (or dispensing station 400 collectively); foam board insertion station 500; first and second levelling stations 601 and 602 (or levelling station 600 collectively); first and second troweling stations 701 and 702 (or troweling station 700 collectively); and one or more optional finishing stations (not shown). The finishing stations may be pebble finishing station 800 (FIG. 12) and/or imprint station 900 (FIG. 13). Service unit cabinet 130 may enclose dryer 132, compressor 134, and transformer 136. System 100 further includes a main control system that may be interfaced using main control panel 140 and/or sub-control panel 141. Container 110 may further include ventilation fans 150. There are empty spaces 102 along conveyor system 200 for installation of additional stations, if desired. An overhead view of mobile production system 100 showing the configuration of conveyor system 200 inside container 110 is illustrated in FIG. 20. One skilled in the art will recognize that other configurations may be used without departing from this invention. Further, system 100 may also include lighting, emergency lighting and safety equipment inside container 110, as well as a removable lightning conductor affixed to the exterior of container 110.

Figure 2:
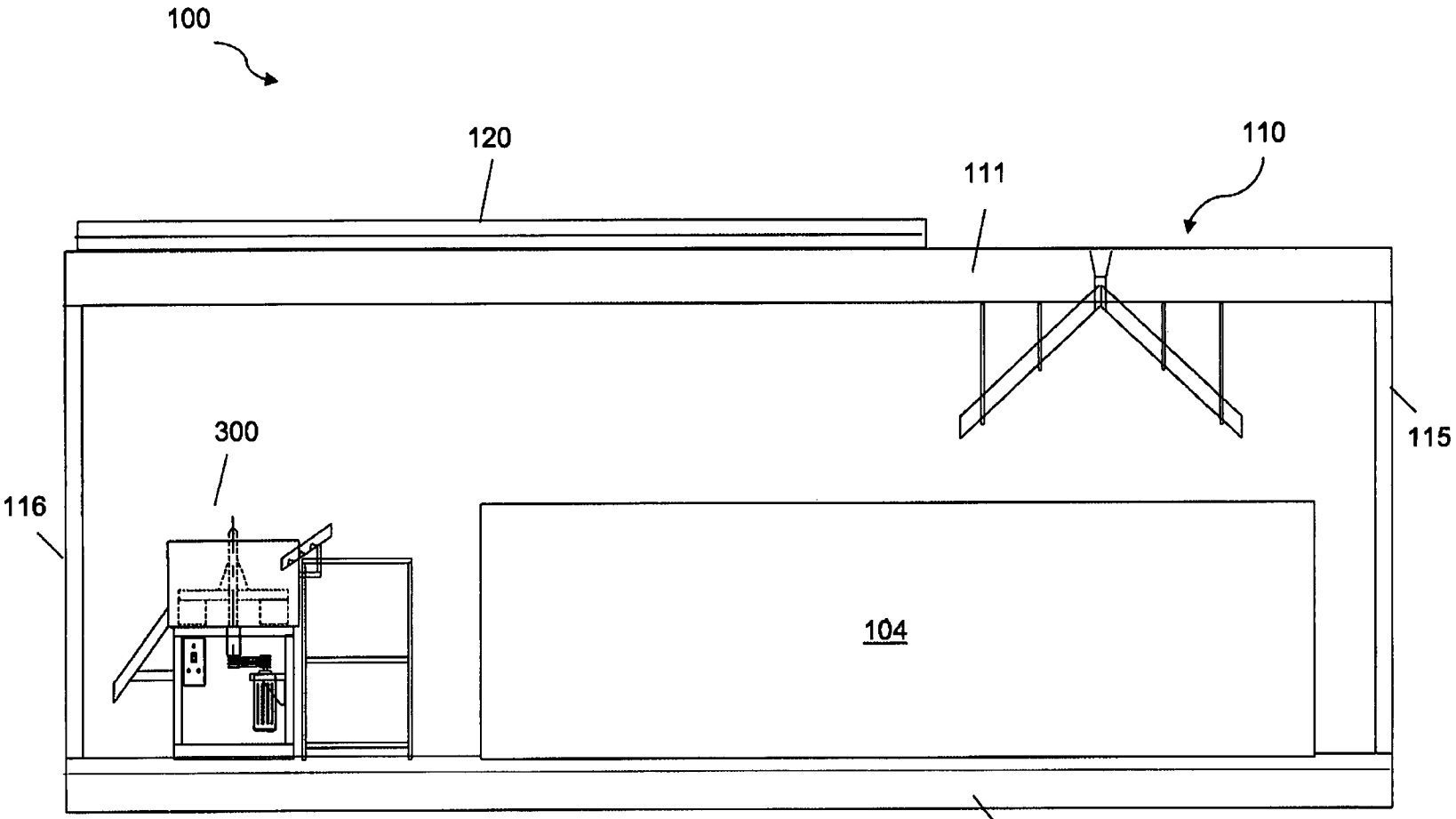
FIG. 2 illustrating a mortar mixing station stored inside a container of the embodiment of the mobile production system as illustrated in FIG. 1.
Figure 3:
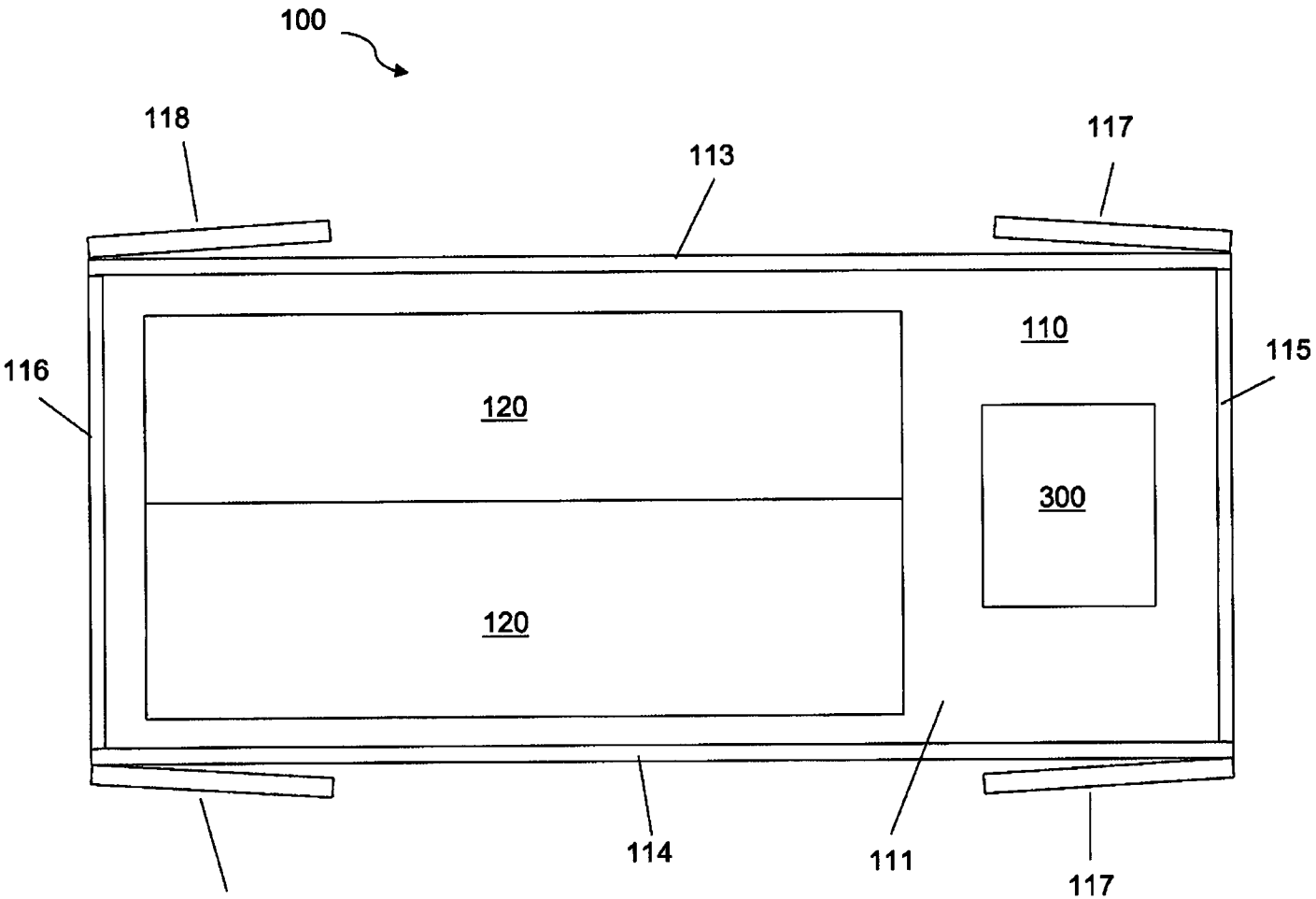
FIG. 3 illustrating a top view of the embodiment of the mobile production system as illustrated in FIG. 1 with solar panels in folding position.
Figure 4:
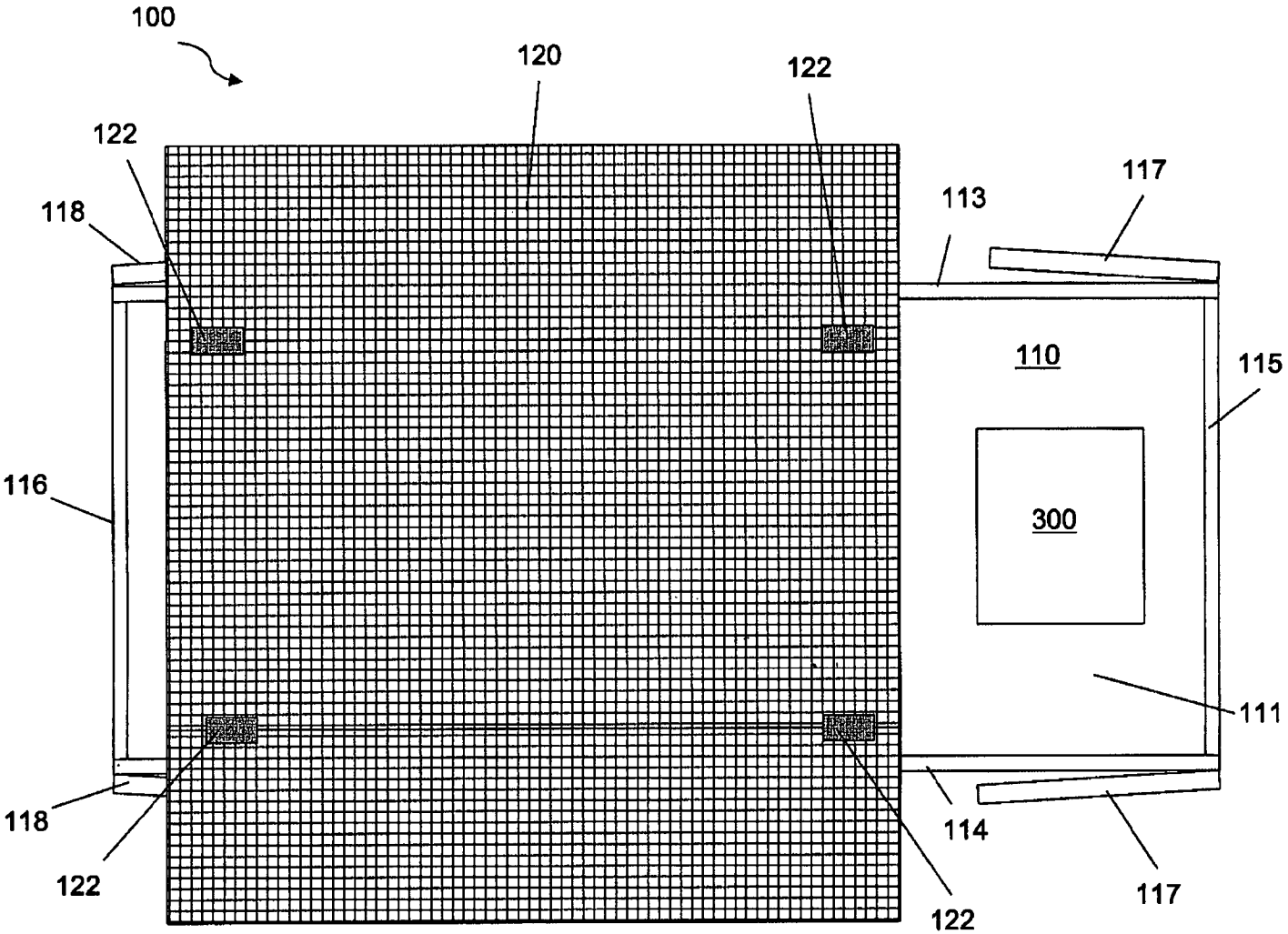
FIG. 4 illustrating a top view of the embodiment of the mobile production system as illustrated in FIG. 1 with solar panels in unfolding position.

As illustrated in FIGS. 1-4, container 110 has a top side 111, a bottom side 112, a first side 113, a second side 114, a first end 115, and a second end 116. First end 115 and/or second end 116 of container 110 may affixed with doors 117 and 118, which can be fully opened during operation of system 100 as illustrated in FIGS. 3 and 4. A floor on the inner bottom side 112 of container 110 is coated with a layer of anti-slip coating 119. Container 110 is a robust, stackable metal box, and preferably a typical size of a standard international shipping/cargo container, such as 30 feet or 40 feet in length, and 7.5 feet or 8.5 feet in height. One skilled in the art will recognize that containers of other dimensions that are mobile may be used without departing from this invention. Furthermore, one skilled in the art will recognize that container 110 is mobile and may be lifted by a crane, carried by a truck, and/or stacked on board a ship to transport container 110 between locations.

FIG. 2 illustrates mortar mixing station 300 stored inside container 110 of mobile production system 100. During transport of system 100, mortar mixing station 300 is removed from the outer top side 111 of container 110 and stored inside container 110. All manufacturing stations (whether unassembled, partially assembled, or fully assembled), any modules and components of system 100, and possibly raw materials for fabricating the composite cement panels (collectively illustrated as a box 104) are also stored inside container 110 during transport of system 100.

FIG. 3 illustrates a top view of mobile production system 100 with solar panels 120 in a folded position (or first position) and affixed to an outer top side 111 of container 110 proximate mortar mixing station 300. In the folded position, solar panels 120 are folded to within the perimeter of top side 111 of container 110 to protect solar panels 120 during transport of system 100. FIG. 4 illustrates solar panels 120 in an unfolded position (or second position). In the unfolded position, solar panels 120 are exposed and extend beyond the perimeter of top side 111 of container 110 to collect solar energy and generate electricity for mobile production system 100. A mounting structure for solar panels 120 includes movable hinge elements 122 affixed to solar panels 120 to allow solar panels 120 to move between the folded and unfolded positions. In the event that electricity generated by solar panels 120 is insufficient for system 100, transformer 136 inside container 110 may also be included. Solar panels 120 may be removable from outer top side 111 of container 110. The removed solar panels 120 may be stored inside container 110 during transport of system 100. One skilled in the art will recognize that solar panels 120 may be formed in different types, sizes, and shapes; and affixed to container 110 in other manners without departing from this invention. Although multiple solar panels are illustrated in FIGS. 1-4, a single solar panel may also be used without departing from this invention. Further, a foldable rollable membrane type of solar panel may be used without departing from this invention.

Figure 5:
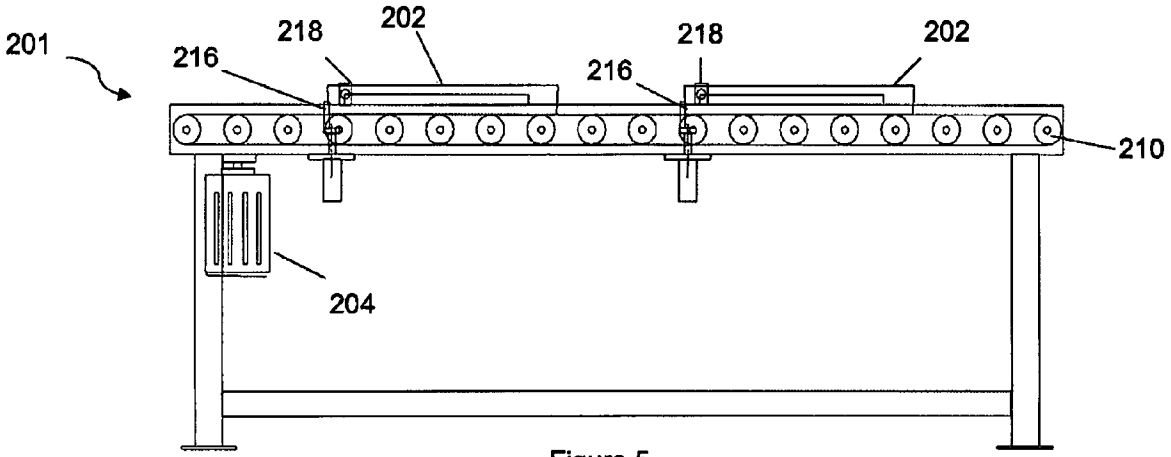
FIG. 5 illustrating a side view of a conveyor system of the embodiment of the mobile production system illustrated as in FIG. 1.
Figure 6:
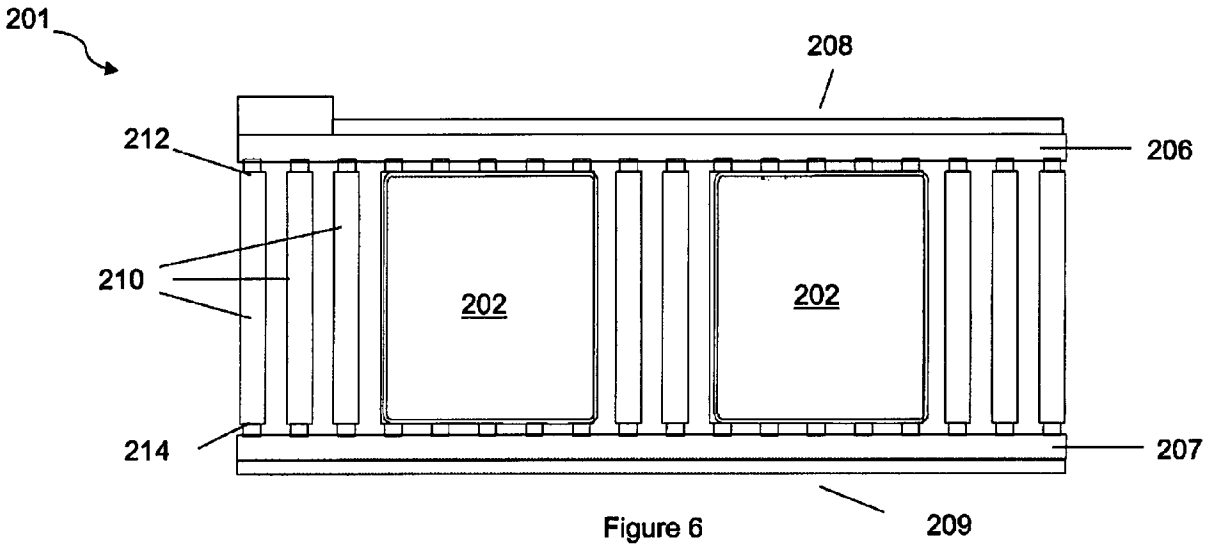
FIG. 6 illustrating a top view of the conveyor system as illustrated in FIG. 5.

Conveyor system 200 illustrated in FIG. 1 is made up of multiple conveyor modules 201 (FIGS. 5 and 6) connected in line and aligned substantially along a longitudinal axis from first end 115 to second end 116 of container 110. In particular embodiments, conveyor system 200 is configured with 6 conveyor modules 201. Conveyor system 200 transfers casting tray 202 to each of the manufacturing stations when system 100 is in operation. FIGS. 5 and 6 illustrate a side view and a top view of conveyor module 201. Conveyor module 201 includes motor 204 driving two parallel conveyor belts 206 and 207 proximate first side 208 and second side 209 of conveyor module 201. A plurality of elongated rollers 210, preferably made of metal, aligned between two conveyor belts 206 and 207. Each roller 210 has first end 212 in contact with first conveyor belt 206 and second end 214 in contact with second conveyor belt 207. Conveyor belts 206 and 207 are driven by motor 204 to cause rollers 210 to rotate. Casting tray 202 rests upon rotating rollers 210 and travels from one station to another station. Conveyor module 201 may include stopper 216 and zone sensor 218 affixed substantially to one of first side 208 or second side 209 of conveyor module 201 and are communicatively connected to the main control system. In some embodiments of this invention, zone sensor 218 detects casting tray 202 in an intended zone. In some particular embodiments, sensor 218 transmits a signal to the main control system to trigger an alarm if casting tray 202 is not detected in a predetermined amount of time to indicate jammed or missing tray along conveyor module 201.

When conveyor module 201 is in operation, rollers 210 rotate continuously and stopper 216 is in an extended position to prevent casting tray 202 from travelling through conveyor module 201. In accordance with the shown embodiment, a signal is sent to the main control system to trigger a manufacturing station to begin a manufacturing process performed by the station responsive to a detection of the presence of casting tray 202 when casting tray 202 is detected by zone sensor 218. After completion of the process, stopper 216 is released and casting tray 202 is allowed to leave conveyor module 201 and travel to the next manufacturing station. Once casting tray 202 left the detecting zone, i.e. zone sensor 218 is off, stopper 216 is activated to return to an extended position.

Figure 7:
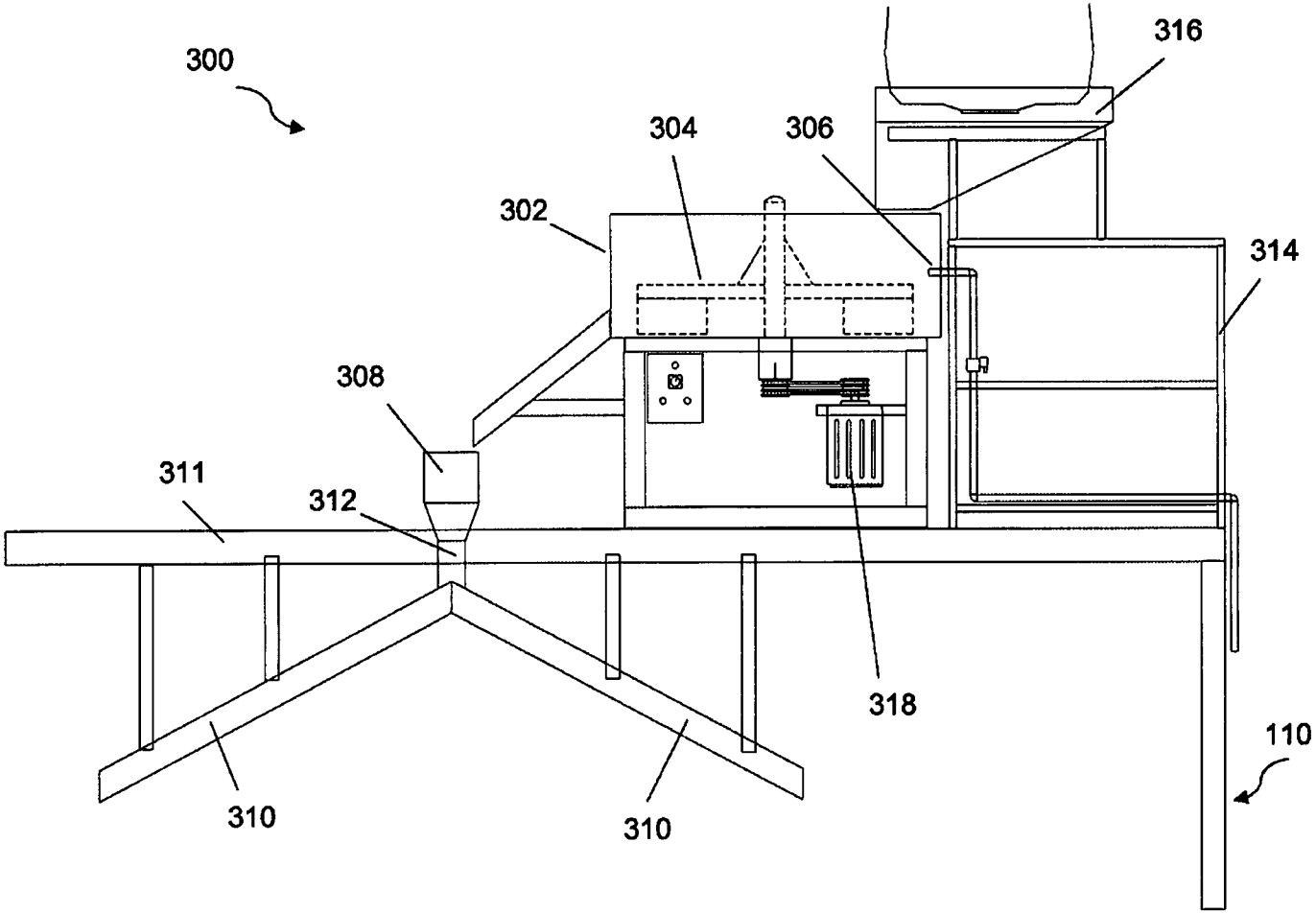
FIG. 7 illustrating a side view of a mortar mixing station of the embodiment of the mobile production system as illustrated in FIG. 1.

FIG. 7 illustrates a side view of mortar mixing station 300 of mobile production system 100 for preparing a pre-mixed mortar for casting the composite cement panel. Mortar mixing station 300 is removably affixable to an outer top side 111 of container 110 proximate first end 115 of container 110 when system 100 is in operation. Mortar mixing station 300 is removed from the outer top side 111 of container 110 and stored inside container 110 during transport of system 100. Mortar mixing station 300 comprises mixing tank 302 and loading chutes 310. Mixing tank 302 includes stirrer 304 driven by motor 318. Mixing tank 302 is supplied with an appropriate ratio of mortar powder from loading hopper 316 and water from water inlet 306. A water sensor may be affixed at water inlet 306 to control the amount of water required for mixing with the mortar powder. The mortar prepared in mixing tank 302 is poured into hopper 308 affixed through an opening 312 in top side 111 of container 110. Hopper 308 connects to two loading chutes 310 affixed to the inner top side 111 of container 110. Loading chutes 310 deliver the mortar to dispensing tank 403 (FIG. 8) of first dispensing station 401 and second dispensing station 402 inside container 110. Mortar mixing station 300 may further include platform 314. Platform 314 is preferably made of metal, mounted on a surface proximate mixing tank 302 to allow a user to stand on platform 314 for loading raw materials into mixing tank 302 and/or doing maintenance work. Platform 314 includes multiple legs (not shown) mounted firmly on the surface of the ground. Mortar mixing station 300 has to be cleaned everyday or after each production shift to prevent mortar from building up and hardening in all of the components of mortar mixing station 300.

Multiple manufacturing stations are installed inside container 100. The manufacturing stations are located proximate conveyor system 200 and aligned along a longitudinal axis of container 110 from first end 115 to second end 116 of container 110. Preferably, as illustrated in FIG. 20, maintenance walkway 252 and production walkway 254 are formed proximate first side 113 and second side 114 of container 110 by the configuration of the manufacturing stations in container 110. Production walkway 254 allows a user to transport raw materials, loading and/or unloading casting trays, and perform normal production routines for each of the stations. Maintenance walkway 252 allows a technician to access an opposing side of the manufacturing station for maintenance and troubleshooting. Each of the manufacturing stations operates independently from the other stations. Further, each station is preferably connected to and controlled by a main control system. This modular system of processing stations simplifies the design and control of system 100 to allow easy maintenance of system 100. By operating independently from one another, the manufacturing stations prevent a breakdown of any one of the stations from affecting the operation of the entire system 100. One skilled in the art will recognize that the number, types, and ordering of the stations depend upon the specific product recipe and may vary without departing from this invention. The order of the stations illustrated in FIG. 1 is arranged in this manner: mortar mixing station 300, first dispensing station 401, first levelling station 601, foam board insertion station 500, second dispensing station 402, second levelling station 602, first troweling station 701, second troweling station 702, and one or more optional finishing stations including imprint station 800 or pebble finishing station 900. The adjustable parameters for each station may vary for different types of product recipes without departing from this invention. Some of the manufacturing stations including mortar mixing station 300 may have a station control panel to allow a user to manipulate the operations of the station and to select a mode of operation of the station, i.e. automatic or manual.

Figure 8:
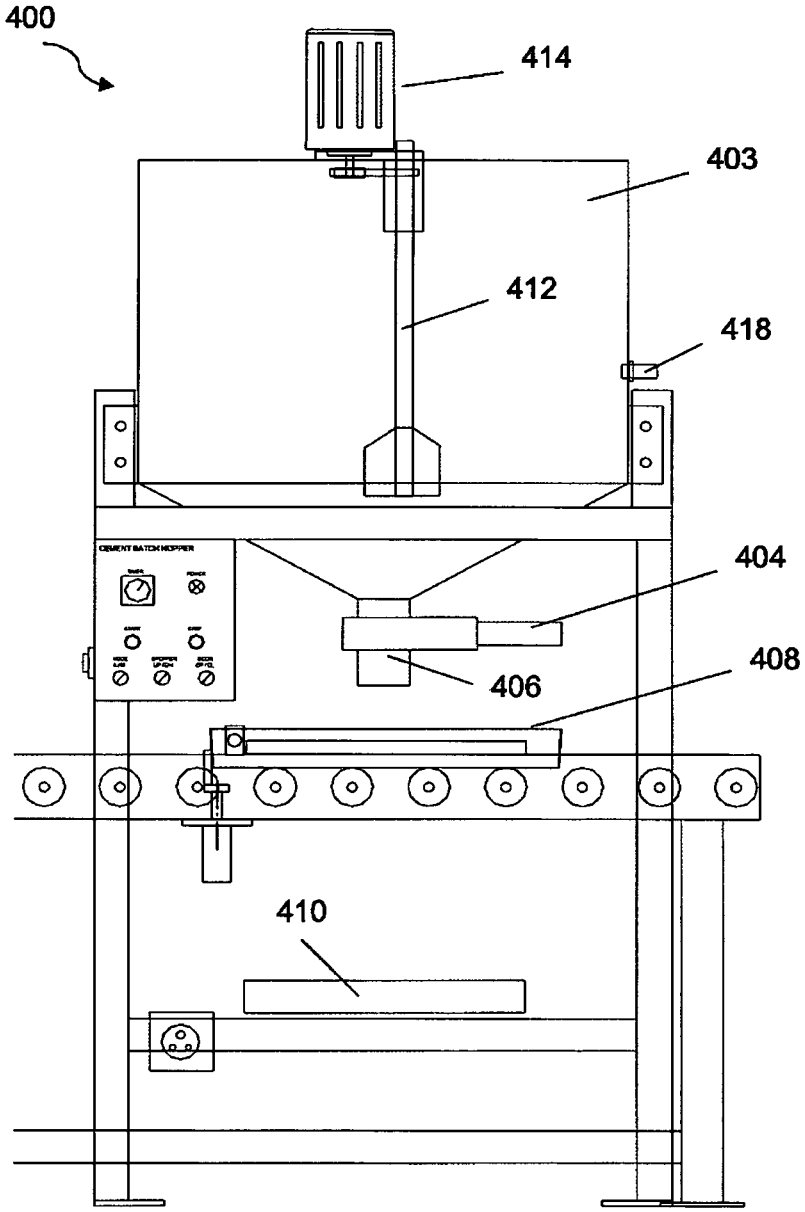
FIG. 8 illustrating a side view of a dispensing station of the embodiment of the mobile production system as illustrated in FIG. 1.

Two dispensing stations 401 and 402 (or dispensing station 400 collectively) are used in mobile production system 100. First dispensing station 401 forms a bottom layer of mortar in an empty casting tray. Second dispensing station 402 forms a top layer of mortar, above and around a form board, in a casting tray transferred from foam board insertion station 500. As the thickness of the top layer and the bottom layer of mortar of a composite cement panel may be different, the amount of mortar dispensed from first dispensing station 401 and second dispensing station 402 may be different. FIG. 8 illustrates a side view of an individual dispensing station 400 of mobile production system 100. Dispensing station 400 comprises dispensing tank 403 and weighing machine (not shown). Dispensing tank 403 includes a shutter 404 affixed to an opening 406 in dispensing tank 403. Shutter 404 moves between an open position and a closed position to dispense a predetermined amount of mortar into casting tray 408. The amount of mortar dispensed into casting tray 408 is controlled by a timer adjustable by a user that causes shutter 404 to move between the open and closed positions. A drip tray 410 may be placed below casting tray 408 for collecting excessive mortar dripping from casting tray 408. Dispensing tank 403 further includes stirrer 412 driven by motor 414 for stirring mortar regularly to further mix the mortar, and create a force to facilitate dispensing of mortar from dispensing tank 403. A weighing machine with a predetermined tolerance may be placed below casting tray 408 to weigh the bottom layer and/or top layer of mortar to ensure the amount of mortar dispensed into casting tray 408 is within a control limit. Sensor 418 is affixed to dispensing tank 403 to detect the level of the mortar in dispensing tank 403. An alarm signal is generated if the level of the mortar in dispensing tank 403 is below a predetermined level.

Figure 9:
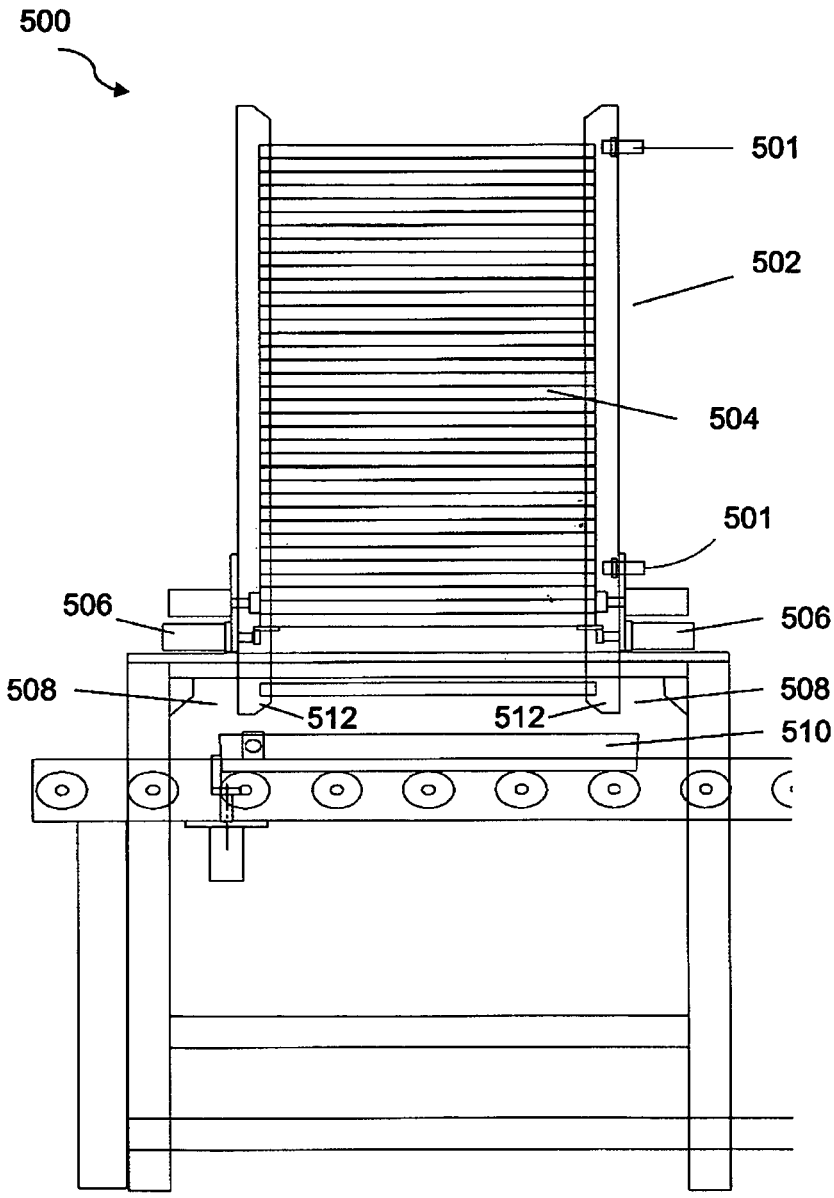
FIG. 9 illustrating a side view of a foam board insertion station of the embodiment of the mobile production system as illustrated in FIG. 1.

Foam board insertion station 500 inserts a piece of foam board into a casting tray filled with a bottom layer of mortar that has been levelled by first levelling station 601. FIG. 9 illustrates a side view of foam board insertion station 500 of mobile production system 100. Foam board insertion station 500 includes loading unit 502 for storing a predetermined number of foam boards 504. The number of foam board 504 stored in loading unit 502 may depend on the thickness of foam board 504 and the height of loading unit 502. In some particular embodiments of this invention, loading unit 502 may store 35 pieces of foam boards. However, any number of foam boards may be stored without departing from this invention. Sensors 501 are affixed to loading unit 502 to detect the foam board level to ensure a minimum number of foam boards 504 are available in loading unit 502. For example, an alarm signal is generated if the presence of less than 5 pieces of foam boards 504 in loading unit 502 is detected by sensors 501. When an escaper 506 affixed to loading unit 502 is released, a piece of foam board 504 drops into casting tray 510 guided by side guides 512 that extend from lower side 508 of loading unit 502.

Figure 10:
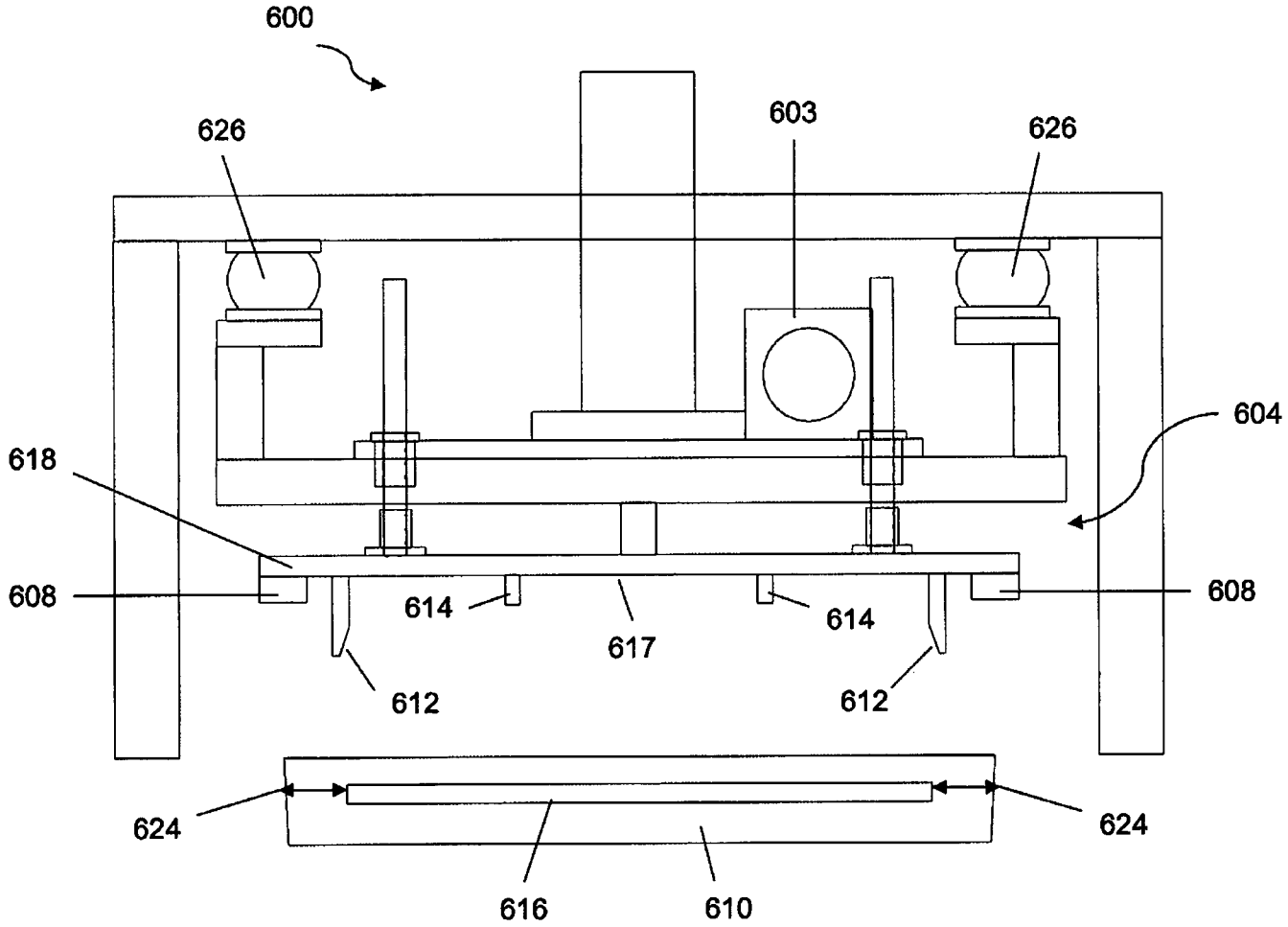
FIG. 10 illustrating a side view of a levelling station of the embodiment of the mobile production system as illustrated in FIG. 1.

Two levelling stations 601 and 602 (or levelling station 600 collectively) are used in mobile production system 100. First levelling station 601 levels the bottom layer of mortar in a casting tray transferred from first dispensing station 401. Second levelling station 602 levels the top layer of mortar in a casting tray transferred from second dispensing station 402. FIG. 10 illustrates a side view of an individual levelling station 600 of mobile production system 100. Levelling station 600 comprises vibration motor 603 and locating unit 604. Locating unit 604 includes tray press plates 608 for securing a casting tray 610, and foam guides 612 and foam press pins 614 for centering and positioning foam board 616 in casting tray 610. Tray press plates 608, foam guides 612, and foam press pins 614 are affixed to bottom surface 617 of plate 618 that is vertically movable. In operation, locating unit 604 is lowered towards casting tray 610 until tray press plates 608 are in contact with the edges of casting tray 610 for securing casting tray 610 in position. Foam guides 612 contact with the edges of foam board 616 to position/align foam board 616 in casting tray 610, leaving gap 624 between the periphery of foam board 616 and the inner side surface of casting tray 610. Foam press pins 614 contact with the top surface of foam board 616 and press foam board 616 into casting tray 610 until foam board 616 is fully encapsulated by mortar and rests upon tray pins that protrude out from the inner bottom surface of casting tray 610 (not shown). Vibration motor 603 vibrates casting tray 610 to level the surface of the mortar for a period of time controlled by a timer, when casting tray 610 (as well as foam board 616 for second levelling station 602) are secured by locating unit 604. The timer may be preset by a user. Vibration of motor 603 is isolated by rubber mountings 626 to prevent interference with other manufacturing stations. As foam board 616 is not present in casting tray 610 at first levelling station 601, foam guides 612 and foam press pins 614 are not functional in this station.

Figure 11:
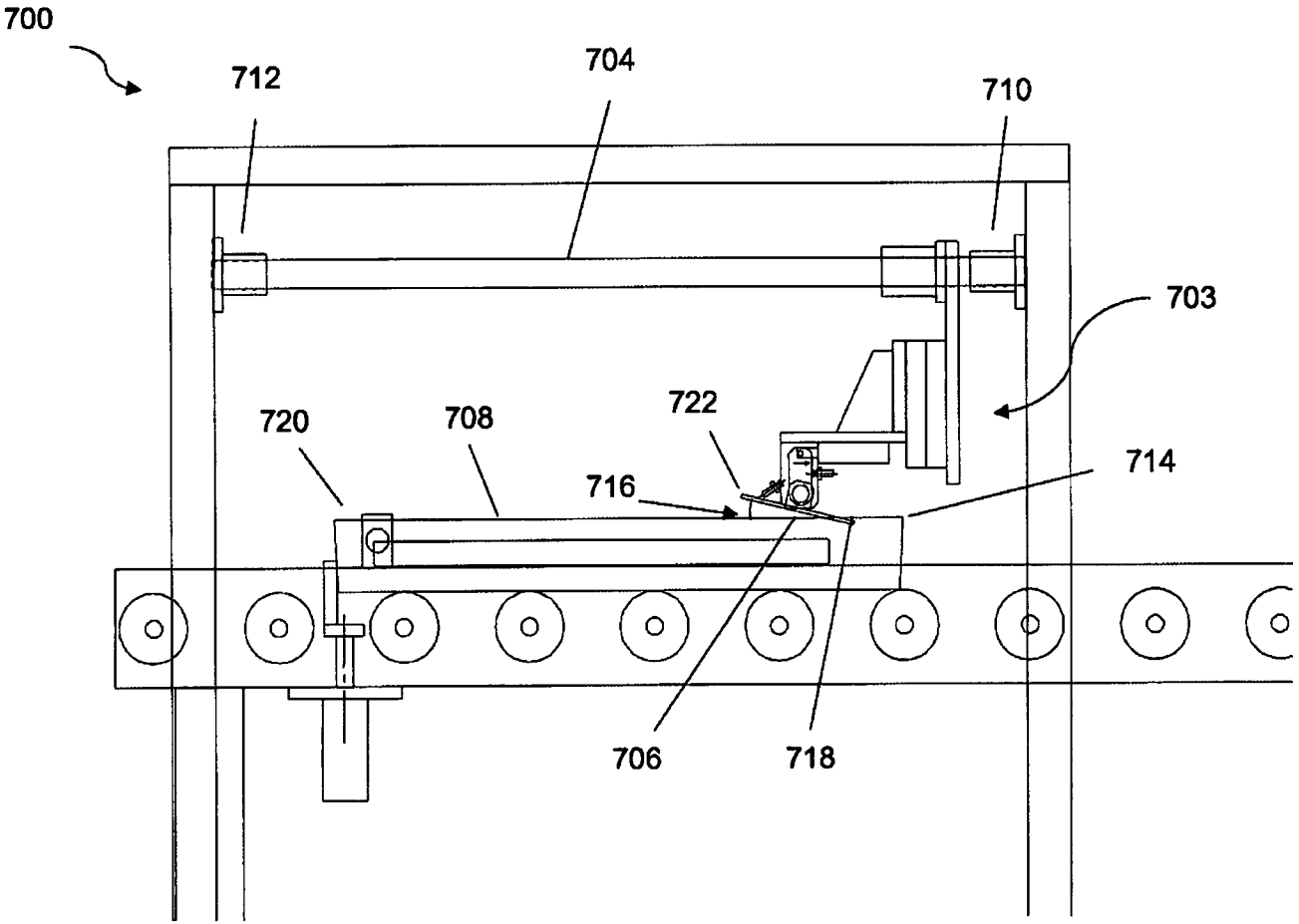
FIG. 11 illustrating a side view of a troweling station of the embodiment of the mobile production system as illustrated in FIG. 1.

Two troweling stations 701 and 702 (or troweling station 700 collectively) are used in mobile production system 100. First troweling station 701 (also referred as coarse troweling station) levels the top surface of a composite cement panel in a casting tray transferred from second levelling station 602. Second troweling station 702 (also referred as smooth troweling station) smooths the top surface of a composite cement panel in a casting tray transferred from first troweling station 701. FIG. 11 illustrates a side view of an individual troweling station 700 of mobile production system 100. Troweling station 700 includes troweling unit 703 and linear shaft 704. Troweling unit 703 includes troweling blade 706. Troweling blade 706 is a thin plate, preferably in rectangular shape, with a length of approximately 50 cm (i.e. approximately the width of a casting tray) for levelling or smoothing the top surface of a composite cement panel in casting tray 708. Troweling unit 703 is affixed to a linear shaft 704. Troweling unit 703 moves between first end 710 and a second end 712 of linear shaft 704. As troweling unit 703 moves along linear shaft 704 from first end 710 to second end 712, troweling blade 706 moves across the top surface of the composite cement panel in casting tray 708. In operation, troweling unit 703 is lowered towards casting tray 708 proximate first edge 714 of casting tray 708. Troweling blade 706 then rotates in a clockwise direction at an adjustable angle 716 with respect to the top surface of casting tray 708 such that first edge 718 of troweling blade 706 is in contact with the top surface of the composite cement panel. One skilled in the art would recognise that angle 716 can be preset to any angle as a design choice. Troweling unit 703 then moves along linear shaft 704 from first end 710 to second end 712, which in turn moving troweling blade 706 from first edge 714 to second edge 720 of casting tray 708 to level or smoothen the top surface of the composite cement panel. When troweling unit 703 reaches second end 712 of linear shaft 704 (i.e. second end 720 of casting tray 708), troweling blade 706 rotates in a counterclockwise direction at an adjustable angle 716 with respect to the top surface of casting tray 708 such that a second edge 722 of troweling blade 706 is in contact with the top surface of the composite cement panel. Troweling unit 703 may remain at second end 712 of linear shaft 704 for a short period before returning to first end 710 of linear shaft 704. The troweling process may be repeated with troweling unit 703 moving between first end 710 and second end 712 of linear shaft 704 for a number of cycles preset by a user. The speed of troweling unit 703 moving along linear shaft 704 and the angle 716 of troweling blade 706 may be adjustable through the main control system and/or the station control panel. First troweling station 701 and second troweling station 702 may be different in the aspects of the design of troweling blade 706, tilted angle 716 of troweling blade 706, as well as the speed of troweling unit 703 moving along linear shaft 704 without departing from this invention. For example, the speed of troweling unit 703 moves along linear shaft 704 is slower in second troweling station 702 than in first troweling station 701 in the shown embodiment. After the troweling process is completed, the level of the top surface of the completed composite cement panel is checked using a level sensor to ensure the height of the panel is within control limit.

The optional finishing station provides a finishing on the top surface of a completed composite cement panel in a casting tray transferred from troweling station 700. The finishing station may include one or more of pebble finishing station 800, imprint station 900, a glass bead station, and a colouring station. FIG. 12 illustrates a side view of pebble finishing station 800 in accordance with one embodiment of mobile production system 100. Pebble finishing station 800 includes a feeding unit 802 and a pressing unit 850. Feeding unit 802 has pebble tank 804 that is filled with pebbles and is movable between first edge 806 and second edge 808 of casting tray 810 to spread pebbles over the top surface of the completed composite cement panel. Hopper 812 above pebble tank 804 releases pebbles into pebble tank 804 when the level of pebble in pebble tank 804 is below a predetermine threshold. Pressing unit 850 includes flat press plate 852 and clamper 854. Press plate 852 presses down on the pebbles and the top surface of the composite cement panel to embed the pebbles in the top surface of the composite cement panel when casting tray 810 is secured by clamper 854.

FIG. 13 illustrates a side view of imprint station 900 in accordance with one embodiment of mobile production system 100. Imprint station 900 includes imprint unit 902 and cleaning unit 950. Imprint unit 902 has imprint stamp 904 that is engraved with a pattern. One skilled in the art will recognize that imprint stamp 904 may be one of multiple imprint stamps having various designs that may be used to form different patterns in the top surface of a completed composite cement panel. When casting tray 906 with a completed composite cement panel is secured in position by clamping element 908, imprint unit 902 is lowered towards casting tray 906 until imprint stamp 904 presses against the top surface of the composite cement panel to form a pattern in the top surface. Cleaning unit 950 is affixed to slide rod 952 below imprint stamp 904. Cleaning unit 950 is movable between first end 954 and second end 956 of slide rod 952 to clean imprint stamp 904. Cleaning unit 950 includes a brush 958 and an oil pan 960. Brush 958 applies oil from oil pan 960 and spins while cleaning unit 950 is moving between first end 954 and second end 956 of slide rod 952 to clean imprint stamp 904.

Figure 14:
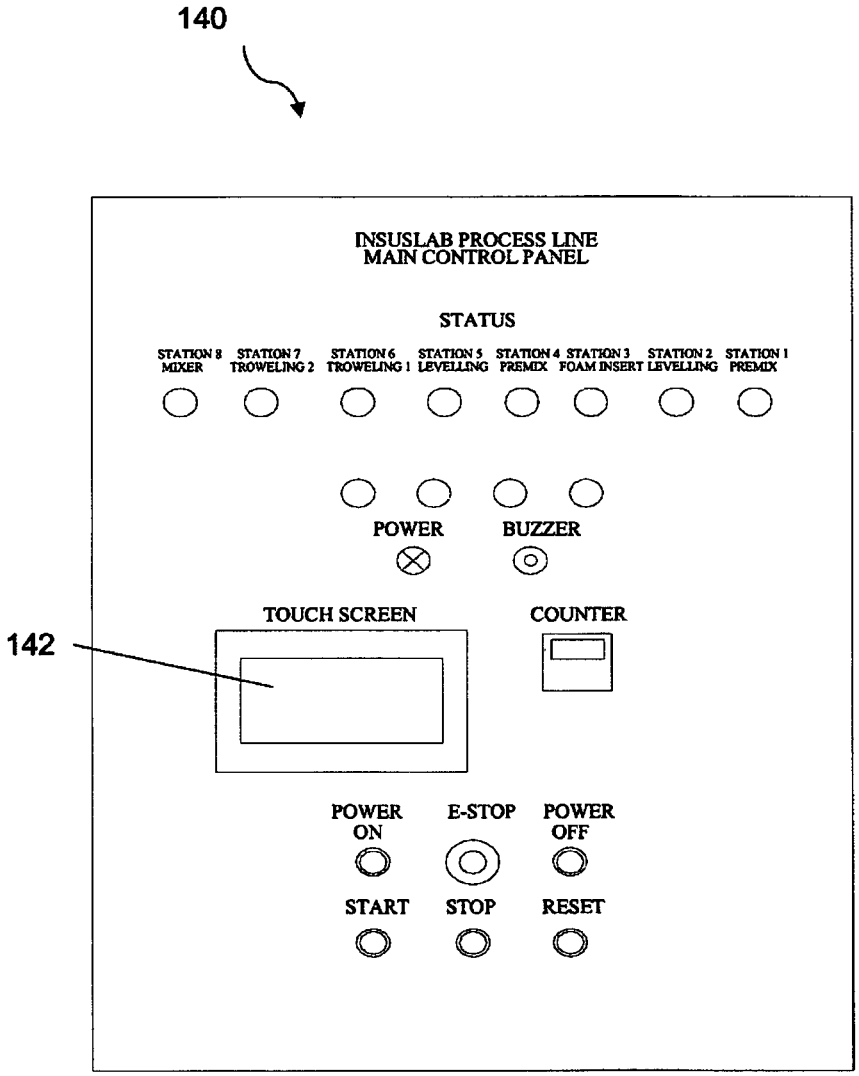
FIG. 14 illustrating a front view of a main control panel in accordance with the embodiment of the mobile production system as illustrated in FIG. 1
Figure 15:
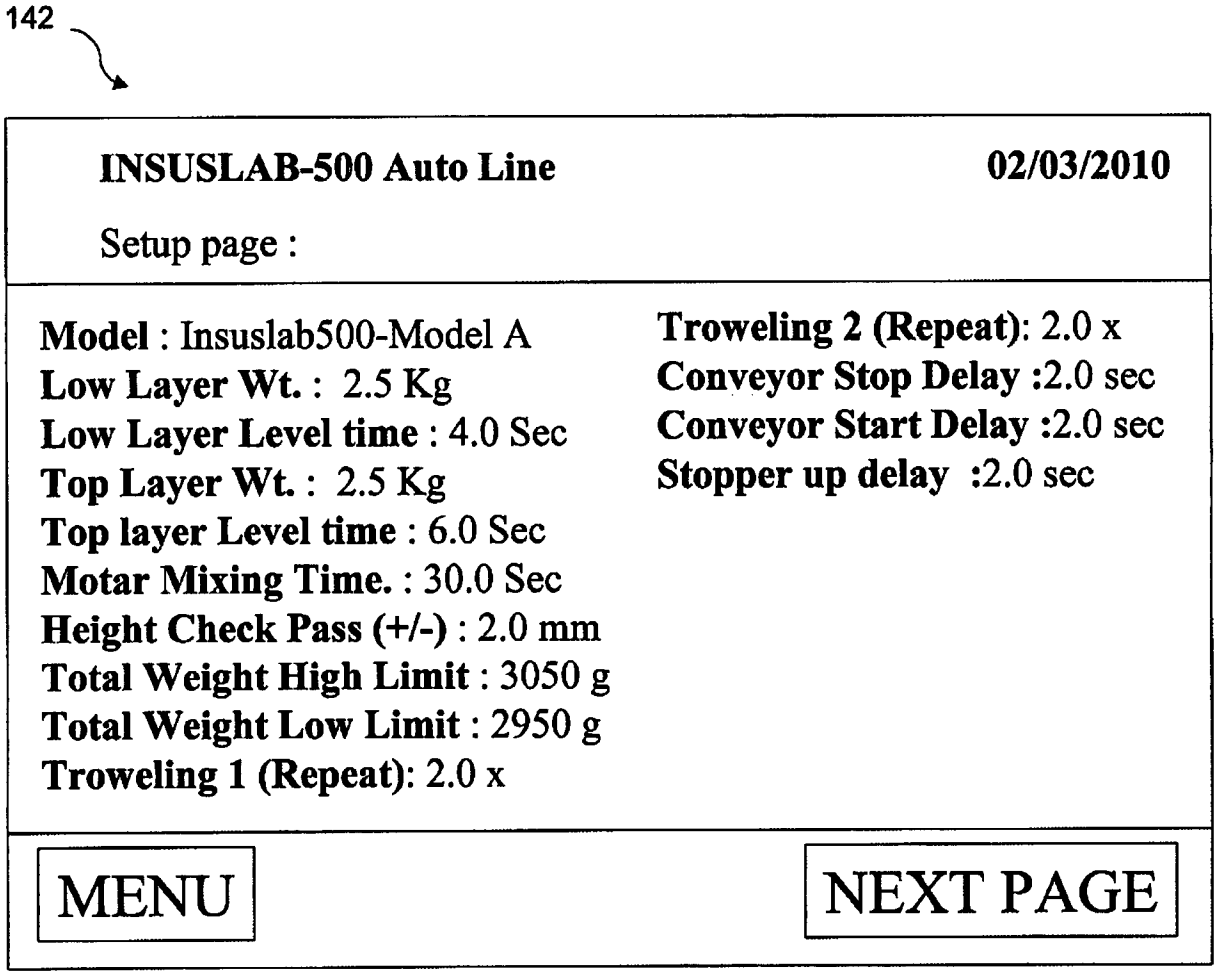
FIG. 15 illustrating a display screen of setup parameters in accordance with the embodiment of the mobile production system as illustrated in FIG. 1

The main control system comprises a processor and a memory to store and execute instructions for controlling and monitoring the entire mobile production system 100 including all of the manufacturing stations, as well as to relay collected data and/or generated data to a main server via a wireless or other network connection. The main control system may provide commands to each manufacturing station to produce a particular type of the composite cement panel (i.e. product recipe) selected by a user. Main control panel 140 and sub-control panel 141 are connected to the main control system and provide a user interface for controlling and monitoring all manufacturing processes in mobile production system 100. A front view of an embodiment of main control panel 140 is illustrated in FIG. 14. The main control system allows a user to select a product recipe and settings for different models of composite cement panels through touchscreen 142. An example of the setup screen for a particular product model is illustrated in FIG. 15. The user may input selections using a touchscreen 142 affixed to main control panel 140 or other like device.

Figure 16:
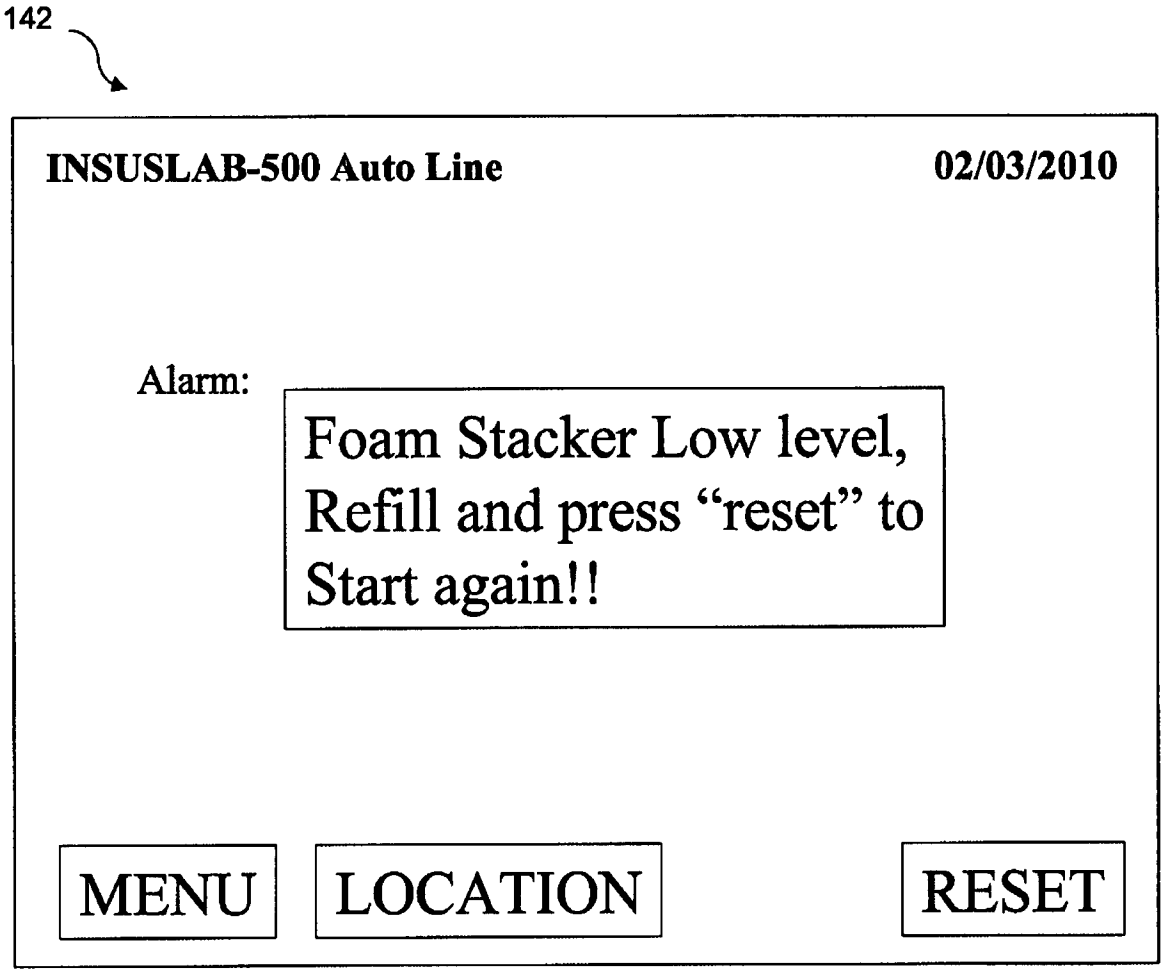
FIG. 16 illustrating a display screen of an alarm message in accordance with the embodiment of the mobile production system as illustrated in FIG. 1.
Figure 17:
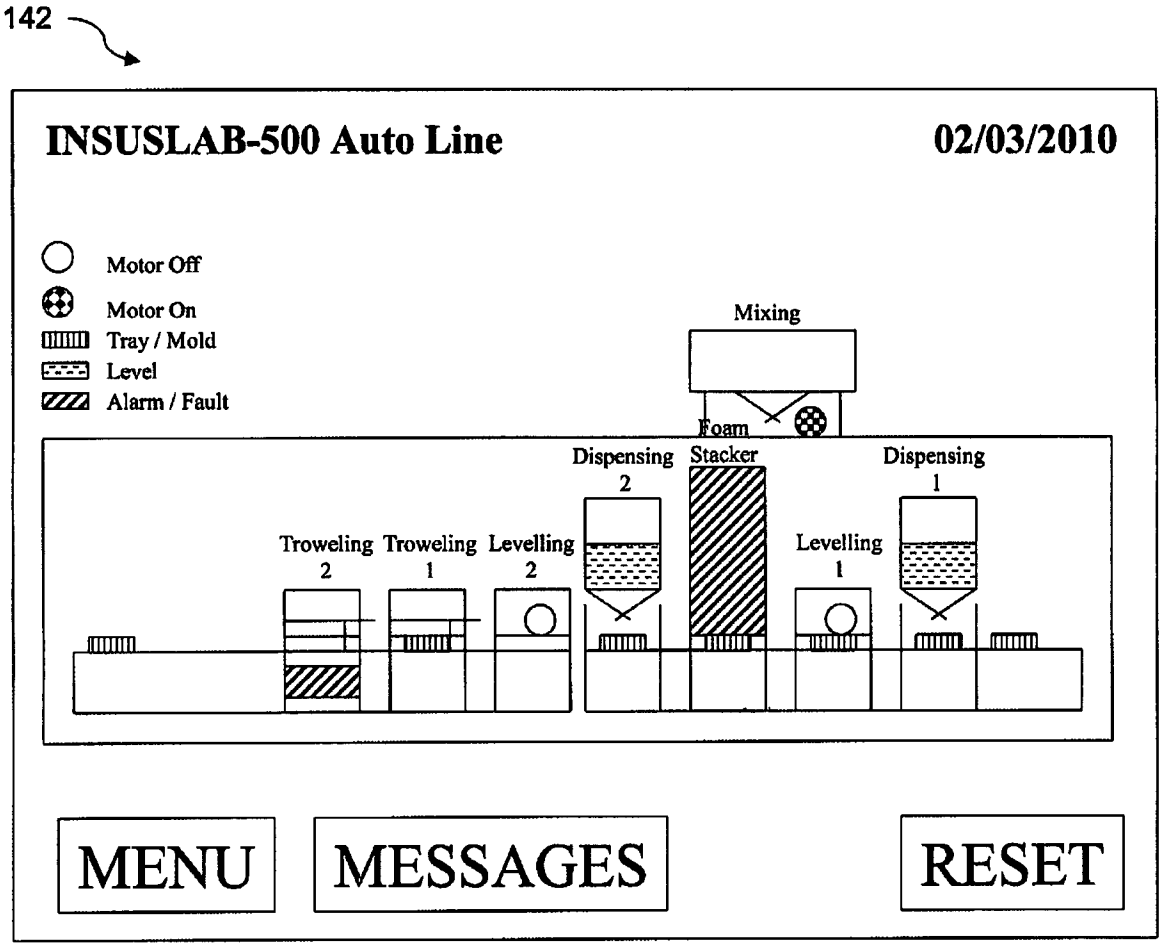
FIG. 17 illustrating a display screen of stations conditions in accordance with the embodiment of the mobile production system as illustrated in FIG. 1.
Figure 18:
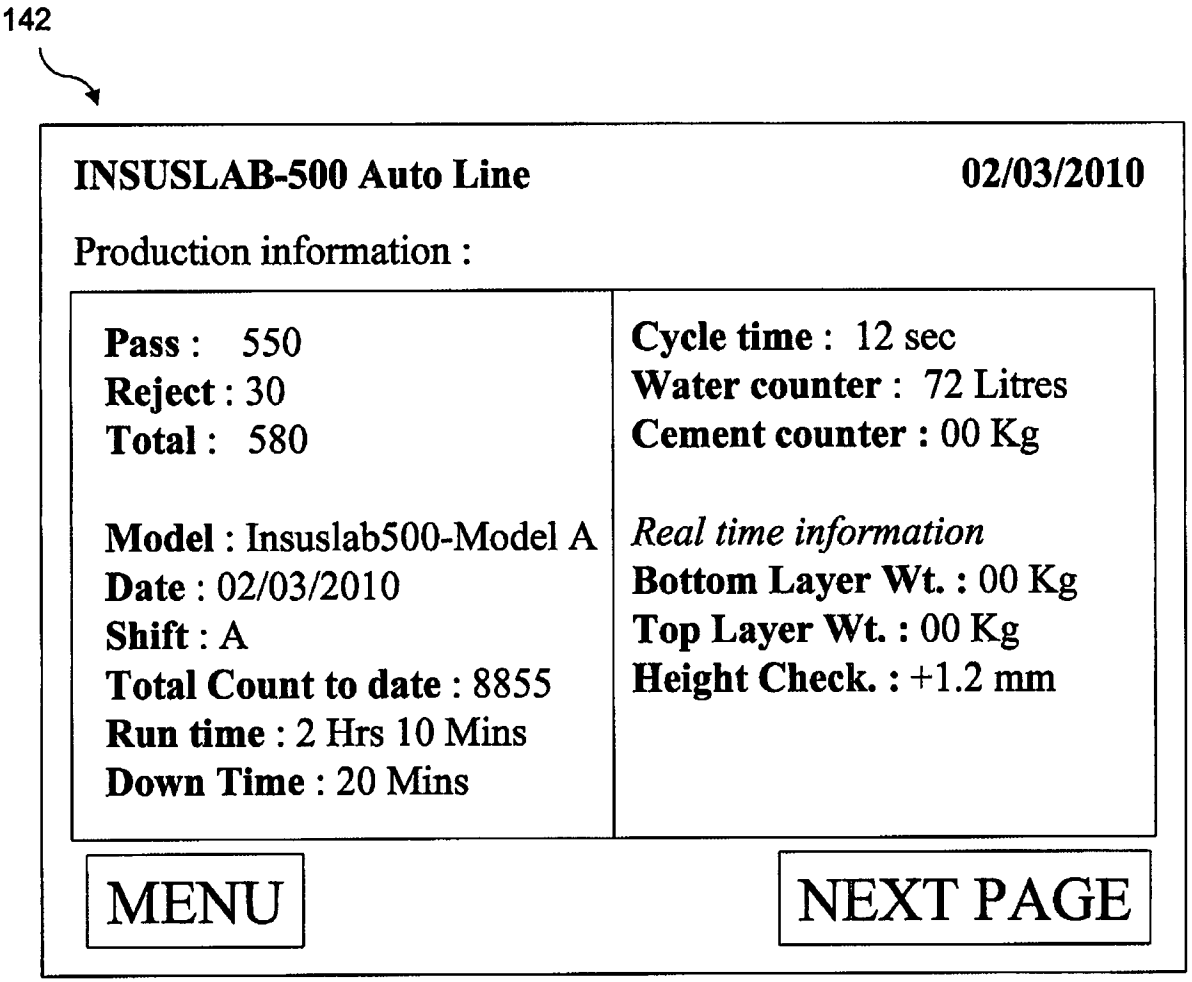
FIG. 18 illustrating a display screen of production information in accordance with the embodiment of the mobile production system as illustrated in FIG. 1.
Figure 19:
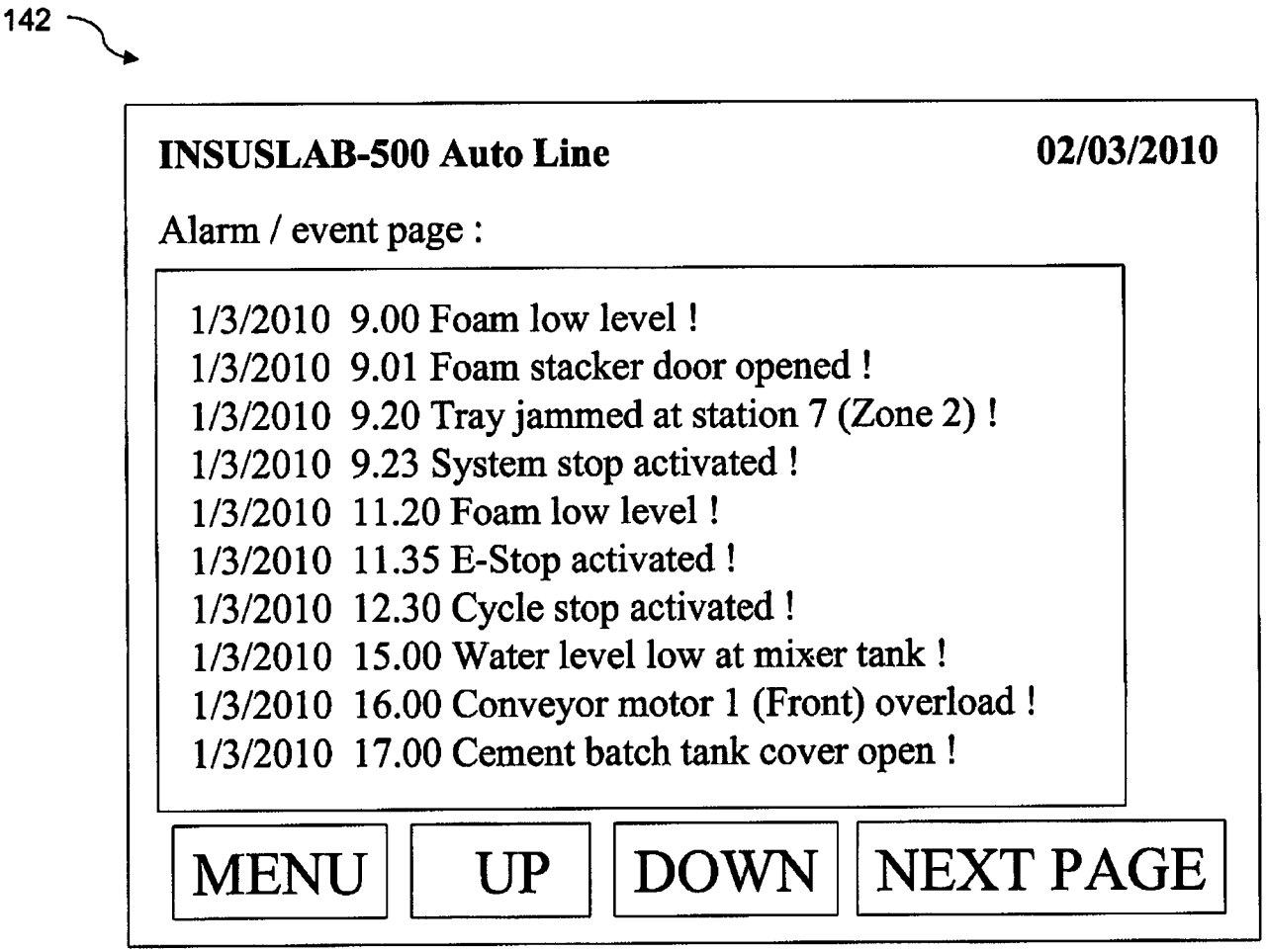
FIG. 19 illustrating a display screen of alarm events in accordance with the embodiment of the mobile production system as illustrated in FIG. 1.

In addition to main control panel 140, some of the manufacturing stations of mobile production system 100 may include a station control panel connected to and controlled by the main control system. Each station control panel is associated to one of the manufacturing stations and provided limited control and monitoring of these stations. Mobile production system 100 also includes an alarm system to monitor and report predefined abnormalities of system 100. A reported alarm message is displayed on touchscreen 142 affixed to main control panel 130. An example of alarm message displayed on touchscreen 142 is illustrated in FIG. 16. When an abnormality is reported, system 100 may modify or stop operations depending on the severity of the abnormality. Some alarm criteria can be "disabled" or "enabled" by a user using touchscreen 142. An example showing the condition of all stations of system 100 is illustrated in FIG. 17. In FIG. 17, an indicating lamp displays the locations of the faults to user. The fault conditions shown in FIG. 17 include "foam board level low" and "conveyor jammed at second troweling station". Some pneumatic cylinders of system 100 are installed with sensors and connected to the main control system to monitor and report any incomplete or abnormal movement of the cylinders. Further, the malfunctioning of any motor triggers the alarm system. System 100 further includes counters, data loggers, and event registers to collect relevant information from the monitored components of the manufacturing stations. The relevant information of each produced composite cement panel will be recorded in a production counter. The recorded data of the relevant information includes date, run time, down time, total counts per shift, total counts for pass and reject, etc. An example of the collected production information displayed on touchscreen 142 is illustrated in FIG. 18. All alarm events are recorded in a chronological order and can be viewed from touchscreen 142 to allow back tracking of the alarm history. An example of alarm events is illustrated in FIG. 19. All collected data including production information and alarm events can be stored in a computer or server that connected to the main control system.

Mobile production system 100 further comprises a transformer 136 for providing electricity to system 100, a compressor 134 for providing compressed air to system 100, and a ventilation fan 150 associated to an opening through container 110 to provide ventilation in container 110.

While preferred embodiments of the present invention have been described and illustrated above, it is to be understood that they are exemplary of the invention and are not to be considered to be limiting. It is expected that those skilled in the art can and will design alternative embodiments that infringe this invention as set forth in the following claims.

The invention claimed is:

1. A mobile production system for manufacturing a composite cement panel embedded with a foam board, the system comprising:

a container having a top side, a bottom side, a first side, a second side, a first end, and a second end;

a conveyor system inside said container aligned substantially along a longitudinal axis of said container from said first end to said second end of said container;

a plurality of manufacturing stations inside said container along said conveyor system wherein a casting tray for casting said composite cement panel travels along said conveyor system to each of said plurality of manufacturing stations during manufacturing of said composite cement panel; and a mortar mixing station removably affixable to an outer top side of said container proximate said first end of said container, the mortar mixing station comprising:

a mixing tank for preparing a mortar; and a loading chute affixed to an inner top side of said container for delivering said mortar prepared by said mixing tank to said plurality of manufacturing stations through an opening in said top side of said container;

wherein said mortar mixing station is affixed to said outer top side of said container during manufacturing of said composite cement panel and said mortar mixing station is removed from said outer top side of said container and placed inside said container during transport of said mobile production system.

2. The mobile production system of claim 1, comprising:
a solar panel affixed to said outer top side of said container for generating electricity for said mobile production system.

3. The mobile production system of claim 2, comprising:
a plurality of solar panels including said solar panel affixed to said outer top side of said container; and
a mounting structure for said plurality of solar panels, the mounting structure comprising a hinge element movable between a first position in which said plurality of solar panels are folded to within a perimeter of said top side of said container to protect said plurality of solar panels during transport of said mobile production system, and a second position in which said plurality of solar panels are unfolded and extend beyond said perimeter of said top side of said container.

4. The mobile production system of claim 1, wherein said container is a standard international shipping container.

5. The mobile production system of claim 1, wherein said plurality of manufacturing stations are arranged substantially along said longitudinal axis of said container to form a production walkway proximate a first one of said first and second sides of said container and a maintenance walkway proximate a second one of said first and second sides of said container.

6. The mobile production system of claim 1, wherein a floor on an inner bottom side of said container is coated with a layer of an anti-slip coating.

7. The mobile production system of claim 1, wherein said container houses said plurality of manufacturing stations during transport of said mobile production system.

8. The mobile production system of claim 1, further comprising:
a main control system comprising:
a processor; and
a memory that stores instructions executable by said processor to control manufacturing processes in said mobile production system.

9. The mobile production system of claim 8, wherein said main control system comprises:
a sensor proximate said conveyor system and connected to said main control system to detect a presence of said casting tray wherein said main control system triggers one of said plurality of manufacturing stations to begin manufacturing process responsive to a detection of the presence of said casting tray.

10. The mobile production system of claim 8, comprising:
a main control panel connected to said main control system to provide a user interface for monitoring and controlling manufacturing processes in said mobile production system.

11. The mobile production system of claim 8, comprising:
a station control panel connected to said main control system wherein said station control panel is associated with one of said plurality of manufacturing stations to provide a user interface for monitoring and controlling said one of said plurality of manufacturing stations and said mortar mixing station.

12. The mobile production system of claim 8, comprising:
an alarm system connected to said main control system for reporting predefined abnormalities of said mobile production system.

13. The mobile production system of claim 8, wherein said main control system provides a command to said plurality of manufacturing stations and said mortar mixing station to produce at least one of a plurality of types of said cement composite panel.

14. The mobile production system of claim 1, wherein said mortar mixing station comprises:
a platform with a plurality of legs mounted on a surface proximate said mixing tank to allow a user to stand on said platform for loading a mortar powder into said mixing tank.

15. The mobile production system of claim 1, wherein said plurality of manufacturing stations comprises:
a dispensing station comprising:
a dispensing tank; and
a shutter affixed to an opening of said dispensing tank, the shutter being movable between an open position and a closed position to dispense a predetermined amount of said mortar into said casting tray controlled by a timer.

16. The mobile production system of claim 15, wherein said loading chute of said mortar mixing station connects to said dispensing tank.

17. The mobile production system of claim 15, wherein said dispensing tank comprises:
a stirrer for stirring said mortar regularly to further mix said mortar and to create a force to facilitate dispensing of said mortar from said dispensing tank.

18. The mobile production system of claim 15, wherein said dispensing station comprises:
a weighing machine placed below said casting tray for weighing said casting tray filled with said mortar.

19. The mobile production system of claim 15, wherein said plurality of manufacturing stations comprise:
a leveling station for leveling said mortar in said casting tray transferred from said dispensing station by said conveyor system.

20. The mobile production system of claim 1, wherein said plurality of manufacturing stations comprises a leveling station, the leveling station comprising:
a locating unit includes:
a plurality of tray press plates to press an edge of said casting tray for securing said casting tray in position;
a plurality of foam guides in contact with an edge of a foam board to center said foam board in said casting tray; and
a plurality of foam press pins for position said foam board in said casting tray by pressing down said foam board so that said foam board is in contact with a plurality of tray pins protruding out from an inner bottom surface of said casting tray.

21. The mobile production system of claim 20, wherein said leveling station comprising:
a vibration motor for vibrating said casting tray filled with said mortar when said casting tray is secured by said locating unit.

22. The mobile production system of claim 20, wherein said plurality of manufacturing stations comprises:
a foam board insertion station for loading a foam board into said casting tray filled with a layer of said mortar leveled by said leveling station.

23. The mobile production system of claim 20, wherein said plurality of manufacturing stations comprises:
a troweling station for smoothing a top surface of said mortar in said casting tray transferred from said leveling station by said conveyor system.

24. The mobile production system of claim 1, wherein said plurality of manufacturing stations comprises:
a foam board insertion station comprising:
a loading unit for storing a plurality of foam boards wherein said loading unit includes a plurality of side guides for guiding one of said plurality of foam boards into said casting tray filled with a layer of said mortar.

25. The mobile production system of claim 24, wherein said plurality of manufacturing stations comprises:

a dispensing station for dispensing a predetermined amount of said mortar into said casting tray inserted with said one of said plurality of foam boards from said foam board insertion station.

26. The mobile production system of claim 1, wherein said plurality of manufacturing stations comprises:

a troweling station comprising:

a troweling unit, the troweling unit comprising a troweling blade for smoothing a top surface of said composite cement panel in said casting tray.

27. The mobile production system of claim 26, wherein said troweling station comprises:

a liner shaft for moving said troweling unit from a first edge to a second edge of said composite cement panel with said troweling blade affixed to said troweling unit tilted at an angle with respect to said top surface of said composite cement panel in said casting tray.

28. The mobile production system of claim 26, wherein said plurality of manufacturing stations comprises:

a finishing station for finishing said top surface of said composite cement panel in said casting tray transferred from said troweling station through said conveyor system.

29. The mobile production system of claim 1, wherein said plurality of manufacturing stations comprises:

a pebble finishing station comprising:

a feeding unit filled with pebbles for spreading pebbles over a top surface of said composite cement panel.

30. The mobile production system of claim 29, wherein said pebble finishing station comprises:

a pressing unit having a press plate to press said pebbles into said top surface of said composite cement panel.

31. The mobile production system of claim 1, wherein said plurality of manufacturing stations comprises:

an imprint station comprising:

an imprint unit includes an imprint stamp for forming a pattern in said top surface of said composite cement panel.

32. The mobile production system of claim 31, wherein said imprint station comprises:

a cleaning unit includes:

a brush; and an oil pan wherein said brush applies oil from said oil pan to clean said imprint stamp.

* * * * *